US006579827B2

(12) United States Patent
Suzuki

(10) Patent No.: US 6,579,827 B2
(45) Date of Patent: Jun. 17, 2003

(54) MULTI-COLOR IMAGE-FORMING MEDIUM

(75) Inventor: Minoru Suzuki, Tochigi (JP)

(73) Assignee: Pentax Corporation, Tokyo (JP)

( * ) Notice: Subject to any disclaimer, the term of this patent is extended or adjusted under 35 U.S.C. 154(b) by 121 days.

(21) Appl. No.: 09/840,102

(22) Filed: Apr. 24, 2001

(65) Prior Publication Data

US 2001/0056038 A1 Dec. 27, 2001

(30) Foreign Application Priority Data

Apr. 28, 2000 (JP) ..... 2000-129419
May 2, 2000 (JP) ..... 2000-133768

(51) Int. Cl.[7] ..... B41M 5/34
(52) U.S. Cl. ..... 503/204; 503/215
(58) Field of Search ..... 503/204, 215, 503/226

(56) References Cited

U.S. PATENT DOCUMENTS

| | | | | |
|---|---|---|---|---|
| 4,444,833 | A | 4/1984 | Moriguchi et al. | 503/204 |
| 5,104,767 | A | 4/1992 | Nakamura | 430/138 |
| 5,501,946 | A | 3/1996 | Takagi et al. | 430/573 |
| 6,106,173 | A | 8/2000 | Suzuki et al. | 400/120.02 |
| 6,109,800 | A | 8/2000 | Suzuki et al. | 400/120.02 |
| 6,139,914 | A | 10/2000 | Suzuki et al. | 427/213.3 |
| 6,161,971 | A | 12/2000 | Suzuki et al. | 400/120.01 |
| 6,259,464 | B1 | 7/2001 | Suzuki et al. | 347/172 |

FOREIGN PATENT DOCUMENTS

| | | |
|---|---|---|
| JP | 57150600 | 9/1982 |
| JP | 58-33492 | 2/1983 |
| JP | 58-82785 | 5/1983 |
| JP | 61137787 | 6/1986 |
| JP | 4-292985 | 10/1992 |
| JP | 6-51422 | 2/1994 |
| JP | 8-224962 | 9/1996 |
| JP | 8-282115 | 10/1996 |
| JP | 9-76634 | 3/1997 |

OTHER PUBLICATIONS

English Language Abstract of JP 57–150600.

English Language Abstract of JP 6–51422.

English Language Abstract of JP 58–82785.

English Language Abstract of JP 58–33492.

*Primary Examiner*—B. Hamilton Hess
(74) *Attorney, Agent, or Firm*—Greenblum & Bernstein, P.L.C.

(57) ABSTRACT

In a multi-color image-forming medium, a substrate is coated with a color-developing layer, which is formed as a heat-sensitive color-developing layer containing a plurality of pressure-sensitive microcapsules uniformly distributed therein. Each microcapsule is filled with a dye exhibiting a first single-color, and features a characteristic to be broken when being subjected to a predetermined pressure. The heat-sensitive color-developing layer features a characteristic to be molten when being subjected to a first temperature, so that the microcapsules can be directly subjected to the predetermined pressure. The heat-sensitive color-developing layer further features a thermal-color-developing characteristic to develop a second single-color when being subjected to a second temperature more than the first temperature.

28 Claims, 13 Drawing Sheets

MULTI-COLOR IMAGE-FORMING MEDIUM

BACKGROUND OF THE INVENTION

1. Field of the Invention

The present invention relates to a multi-color image-forming medium which is constituted such that at least two colors are developed to form a multi-color image.

2. Description of the Related Art

As a conventional type of multi-color image-forming medium, there is known a heat-sensitive color-developing sheet, which is constituted such that at least two colors can be developed. In general, such a heat-sensitive color-developing sheet comprises a sheet of paper coated with a heat-sensitive color-developing layer containing at least two kinds of leuco-pigment components and a color developer component. As is well known, a leuco-pigment per se exhibits no color. Namely, usually, the leuco-pigment exhibits milky-white or transparency, and reacts with the color developer, to thereby produce a given single-color (e.g. magenta, cyan or yellow). The leuco-pigment components, contained in the color-developing layer, feature different color-developing temperatures such that different colors can be obtained at the respective color-developing temperatures.

For example, when the leuco-pigment components, contained in the color-developing layer, are composed of respective magenta- and and cyan-developing leuco-pigments featuring low and high color-developing temperatures, respective magenta and blue can be obtained at the low and high color-developing temperatures thereof. Namely, when a first temperature between the low magenta-developing temperature and the high cyan-developing temperatures is locally exerted on the color-developing layer, only the magenta-developing leuco-pigment component reacts with the color developer component so that magenta is developed at the localized area where the first temperature is exerted. Also, when a second temperature, higher than the high cyan-developing temperature, is locally exerted on the color-developing layer, both the magenta- and cyan-developing leuco-pigment components react with the color developer component so that blue is developed as a mixture of magenta and cyan at the localized area where the second temperature is exerted.

As is apparent from the aforesaid example, it is impossible to independently develop cyan by the cyan-developing leuco-pigment component. Thus, the conventional multi-color image-forming medium is inferior in efficiency of color development, as it is possible to only independently develop a leuco-pigment component exhibiting the lowest color-developing temperature.

Also, in the aforesaid example, the temperature difference between the low magenta-developing temperature and the high cyan-developing temperature must be sufficiently high, before development of pure magenta can be obtained on the color-developing layer. Namely, if the temperature difference between the magenta-developing temperature and the cyan-developing temperatures is too low, a part of the cyan-developing leuco-pigment component may undesirably react with the color developer component at the first temperature for the development of magenta, resulting in the development of magenta with a cyan tint.

Further, in the aforesaid example, the low magenta-developing temperature must be more than 100° C., before erroneous and accidental development of magenta can be prevented, because the color-developing layer may be frequently exposed to, for example, a temperature in a range of 80 to 100° C. under ordinary circumstances. Thus, if the low magenta-developing temperature is less than 100° C., the erroneous and accidental development of magenta may often occur.

Accordingly, in the conventional multi-color image-forming medium, a combination of different leuco-pigments, which can be utilized to form a heat-sensitive color-developing layer, is severely and considerably restricted, because respective various leuco-pigments feature inherent color-developing temperatures. In the aforesaid example, if one is optionally selected from among various magenta-developing leuco-pigments, it cannot be ensured that there is a cyan-developing leuco-pigment which can be combined with the selected magenta-developing leuco-pigment.

Conventionally, although a user frequently requires that only one single-color is developed with a desired tone in a multi-color image-forming medium, it is virtually impossible to even obtain the development of only the single-color with the desired tone, because of the severe and considerable restriction of the combination of different leuco-pigments.

Further, the conventional multi-color image-forming medium is inferior in thermal energy efficiency, because the lowest color-developing temperature must be more than 100° C. so that erroneous and accidental development of color is prevented, and because the difference between the low color-developing temperature and the high color-developing temperature must be high.

Furthermore, in the conventional multi-color image-forming medium, of course, it is impossible to utilize a pigment type other than a leuco-pigment.

SUMMARY OF THE INVENTION

Therefore, an object of the present invention is to provide a multi-color image-forming medium which is constituted such that development of only one single-color with a desired tone can be ensured.

Another object of the present invention is to provide a multi-color image-forming medium of the aforesaid type, which features superior efficiency for development of colors and superior thermal energy efficiency.

In accordance with a first aspect of the present invention, there is provided a multi-color image-forming medium which comprises a substrate, and a color-developing layer coated on the substrate. The color-developing layer is formed as a heat-sensitive color-developing layer containing a plurality of pressure-sensitive microcapsules uniformly distributed therein. Each of the microcapsules is filled with a dye exhibiting a first single-color, and features a pressure characteristic to be physically broken when being subjected to a predetermined pressure. The heat-sensitive color-developing layer features a thermal characteristic to be molten when being subjected to a first temperature, which is preferably less than 100° C., so that the microcapsules can be directly subjected to the predetermined pressure. Further, the heat-sensitive color-developing layer features a color-developing characteristic to develop a second single-color when being subjected to a second temperature more than the first temperature.

The heat-sensitive color-developing layer may be composed of a first leuco-pigment component, and a color developer component for the first leuco-pigment component. The color developer component is thermally molten under at least the first temperature, and the first leuco-pigment component reacts with the color developer component, thereby developing the second single-color under at least the second temperature. The heat-sensitive color-developing layer may contain a sensitizer component that regulates a color-developing temperature of the leuco-pigment component such that the leuco-pigment component reacts with the color developer component under at least the second temperature. The heat-sensitive color-developing layer may further contain a second leuco-pigment component which reacts with the color developer component, thereby developing a third single-color under at least a third temperature more than the second temperature.

Optionally, the heat-sensitive color-developing layer may be composed of a first type of heat-sensitive microcapsule filled with a first leuco-pigment, and a color developer component for the first leuco-pigment. The color developer component is molten under at least the first temperature, and the first type of heat-sensitive microcapsule featuring a thermal characteristic to be thermally broken when being subjected to at least the second temperature. The first leuco-pigment reacts with the color developer component, thereby developing the second single-color under at least the second temperature. The heat-sensitive color-developing layer may contain a sensitizer component that regulates a color-developing temperature of the first leuco-pigment such that the first leuco-pigment reacts with the color developer component under at least the second temperature. The heat-sensitive color-developing layer may further contain a second type of heat-sensitive microcapsule filled with a second leuco-pigment, and the second type of heat-sensitive microcapsule features a thermal characteristic to be thermally broken when being subjected to at least a third temperature more than the second temperature. The second leuco-pigment reacts with the color developer component, thereby developing a third single-color under at least the third temperature.

In accordance with a second aspect of the present invention, there is provided a multi-color image-forming medium which comprises a substrate, a pressure/heat-sensitive color-developing layer coated on the substrate and containing a plurality of pressure-sensitive microcapsules uniformly distributed therein. Each microcapsule is filled with a dye exhibiting a first single-color, and features a pressure characteristic to be broken when being subjected to a predetermined pressure. The image-forming medium further comprise a first heat-sensitive color-developing layer coated on the pressure/heat-sensitive color-developing layer. The pressure/heat-sensitive color-developing layer is composed of a binder component for the pressure-sensitive microcapsules, and the binder component features a thermal characteristic to be thermally molten when being subjected to a first temperature, which is preferably less than 100° C., so that the microcapsules can be directly subjected to the predetermined pressure. The first heat-sensitive color-developing layer features a color-developing characteristic to develop a second single-color when being subjected to a second temperature more than the first temperature.

The first heat-sensitive color-developing layer may be composed of a first leuco-pigment component, and a color developer component for the first leuco-pigment component, and the color developer component is thermally molten under at least the first temperature. The first leuco-pigment component reacts with the color developer component, thereby developing the second single-color under at least the second temperature. The first heat-sensitive color-developing layer may contain a sensitizer component that regulates a color-developing temperature of the first leuco-pigment component such that the first leuco-pigment component reacts with the color developer component under at least the second temperature.

In the second aspect of the present invention, the image-forming medium may further comprise a second heat-sensitive color-developing layer coated on the first heat-sensitive color-developing layer, and the second heat-sensitive color-developing layer feature a color-developing characteristic to develop a third single-color when being subjected to a third temperature more than the first temperature but less than the second temperature.

The first heat-sensitive color-developing layer may be composed of a first leuco-pigment component, and a color developer component for the first leuco-pigment component. The color developer component is molten under at least the first temperature, the first leuco-pigment component reacts with the color developer component, thereby developing the second single-color under at least the second temperature. Also, the second heat-sensitive color-developing layer may be composed of a second leuco-pigment component, and a color developer component for the second leuco-pigment component. The color developer component is molten under at least the first temperature, and the second leuco-pigment component reacts with the color developer component, thereby developing the third single-color under at least the third temperature.

The first heat-sensitive color-developing layer may contain a first sensitizer component that regulates a color-developing temperature of the first leuco-pigment component such that the first leuco-pigment component reacts with the color developer component under at least the second temperature. Also, the second heat-sensitive color-developing layer may contain a second sensitizer component that regulates a color-developing temperature of the second leuco-pigment component such that the second leuco-pigment component reacts with the color developer component under at least the third temperature.

Optionally, a boundary layer may be interposed between the pressure/heat-sensitive color-developing layer and the first heat-sensitive color-developing layer to thereby prevent a dye, discharged from a broken pressure-sensitive microcapsule, from being in contact with the first heat-sensitive color-developing layer.

In the second aspect of the present invention, the multi-color image-forming medium may further comprises a second heat-sensitive color-developing layer interposed between the pressure/heat-sensitive color-developing layer and the first heat-sensitive color-developing layer, and the second heat-sensitive color-developing layer features a color-developing characteristic to develop a third single-color when being subjected to a third temperature more than the first temperature but less than the second temperature. The second heat-sensitive color-developing layer also may be composed of a second leuco-pigment component, and a color developer component for the second leuco-pigment component. The color developer component is molten under at least the first temperature, and the second leuco-pigment component reacting with the color developer component, thereby developing the third single-color under at least the third temperature.

Optionally, the first heat-sensitive color-developing layer may be composed of a first type heat-sensitive microcapsule filled with a first leuco-pigment, and a color developer component for the first leuco-pigment component. The color developer component is molten under at least the first temperature, and the first type of heat-sensitive microcapsule features a thermal characteristic to be thermally broken when being subjected to at least the second temperature. The first leuco-pigment reacts with the color developer component, thereby developing the second single-color under at least the second temperature.

Similarly, the second heat-sensitive color-developing layer may be composed of a second type heat-sensitive microcapsule filled with a second leuco-pigment, and a color developer component for the second leuco-pigment component. The color developer component is molten under at least the first temperature, and the second type of heat-sensitive microcapsule features a thermal characteristic to be thermally broken when being subjected to at east the third temperature. The third leuco-pigment reacts with the color developer component, thereby developing the third single-color under at least the third temperature.

BRIEF DESCRIPTION OF THE DRAWINGS

The object and other objects of the present invention will be better understood from the following description and with reference to the accompanying drawings, in which.

DESCRIPTION OF THE PREFERRED EMBODIMENTS

Figure 1:
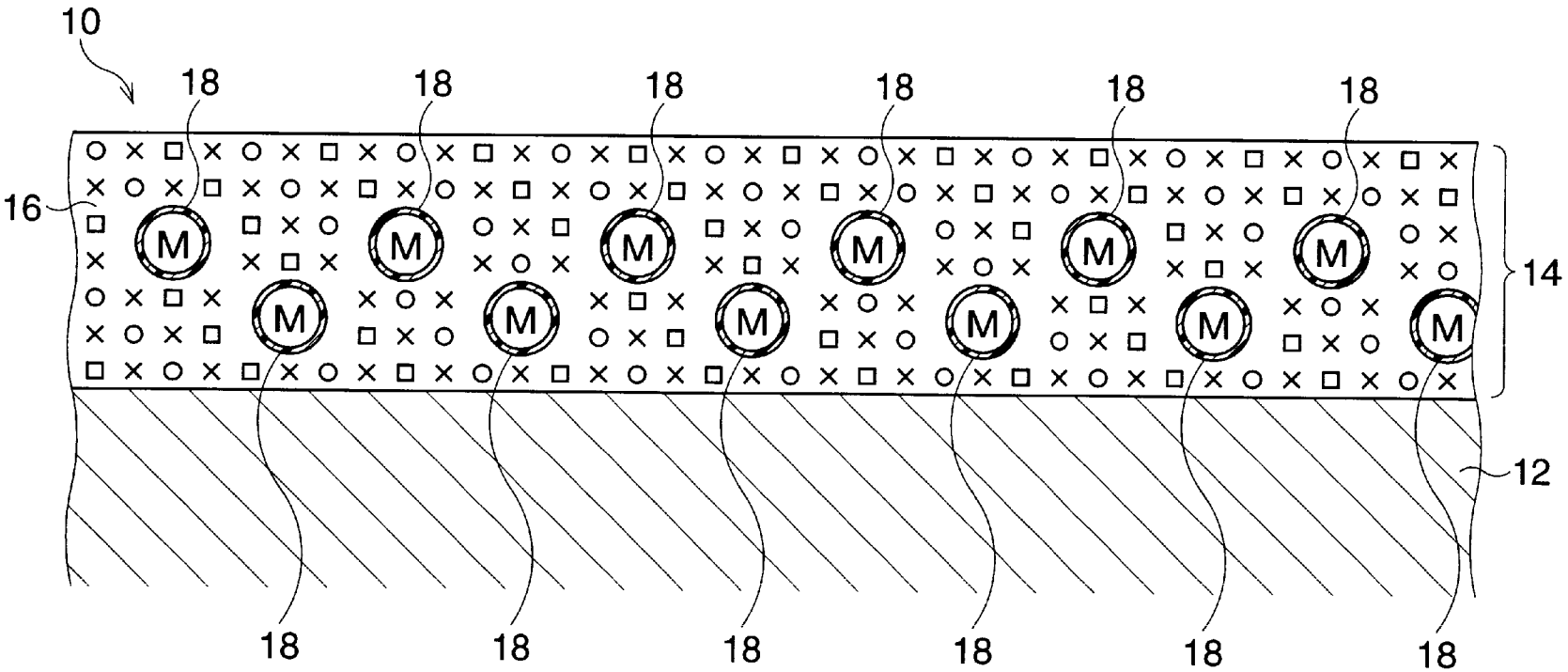
FIG. 1 is a schematic conceptual cross-sectional view showing a first embodiment of a multi-color image-forming medium, according to the present invention.

FIG. 1 schematically shows a first embodiment of a multi-color image-forming medium, generally indicated by reference numeral 10, according to the present invention. The multi-color image-forming medium 10 comprises a sheet-like substrate, such as a sheet of paper 12, and a color-developing layer 14 coated thereon. The color-developing layer 14 is constituted as a heat-sensitive color-developing layer 16 containing a plurality of pressure-sensitive microcapsules 18 uniformly distributed therein. The heat-sensitive color-developing layer 16 is composed of a first leuco-pigment component represented by symbols "□", a second leuco-pigment component represented by symbols "○", and a color developer component represented by symbols "X".

In the first embodiment, the first leuco-pigment component "□" is composed of a cyan-developing leuco-pigment for which Blue-220 is utilized. Blue-220 is available from YAMADA CHEMICAL K. K., and exhibits a melting point of about 147° C., substantially equivalent to a color-developing temperature thereof. The second leuco-pigment component "○" is composed of a black-developing leuco-pigment for which ODB is utilized. ODB is available from YAMAMOTO KASEI K. K., and exhibits a melting point of about 192° C., substantially equivalent to a color-developing temperature thereof. For the color developer component "X", K-5 is utilized. K-5 is available from ASAHI DENKA KOGYO K. K., and exhibits a melting point of about 145° C. Although not showing in FIG. 1, the heat-sensitive color-developing layer 16 contains a suitable amount of acetoacetic anilide which serves as a sensitizer for regulating the color-developing temperatures of the leuco-pigment components "□" and "○" and the melting point of the color developer component "X".

The pressure-sensitive microcapsules 18 are filled with, for example, a magenta ink or dye exhibiting a given tone which is required by a user. In this embodiment, the magenta dye is composed of a transparent liquid vehicle, and a magenta pigment dispersed or dissolved in-the vehicle. For the liquid vehicle, a transparent oil, for example, 2,7-di-isopropyl naphthalene, exhibiting a boiling point of about 300° C., may be utilized. Note, 2,7-di-isopropyl naphthalene is available as KMC-113 from Rütgers Kureha Solvents (RKS) GmbH. For the magenta pigment, Rhodamine Lake T is utilized. Note, in FIG. 1, the magenta dye, contained in each pressure-sensitive microcapsule 18, is represented by the first capital letter "M" of magenta.

A shell wall of each pressure-sensitive microcapsule 18 is formed of a melamine resin colored with the same single-color (usually white) as the paper sheet 12. The pressure-sensitive microcapsules 18 have an average diameter of about 5 to 6 $\mu$m, and the shell wall of each microcapsule 18 has a thickness such that each microcapsule 18 is squashed and broken when being subjected to a pressure of higher than about 0.2 MPa, with a shearing force.

This type of microcapsule can be produced by a suitable polymerization method, such as an in-situ polymerization method. In particular, to produce the microcapsules 18, the following solutions (A), (B) and (C) are prepared:

(A) magenta dye solution:

| | |
|---|---|
| KMC-113 (2,7-di-isopropyl naphthalene) | 100 g |
| Rhodamine Lake T (magenta pigment) | 4 g |

-continued

| | |
|---|---|
| (B) protective colloid aqueous solution: | |
| partly sodium-sulfonated polyvinyl benzenesulfonic acid | 5 g |
| purified water | 95 g |
| (C) melamine-formalin prepolymer aqueous solution: | |
| melamine | 11.2 g |
| formalin | 28.8 g |
| purified water | 40 g |

The formalin for use in the preparation of the melamine-formalin prepolymer aqueous solution (C) is a 37 wt. % formaldehyde aqueous solution, which is regulated to pH9 with a 2 wt. % sodium hydroxide aqueous solution. Namely, a mixture of 11.2 g of the melamine and 28.8 g of the 37 wt. % formaldehyde solution is prepared, and is heated to a temperature of 70° C. After the melamine is completely dissolved, 40 g of the purified water is added, and the resultant mixture is stirred, thereby producing the solution (C).

The solutions (A) and (B) are mixed, and the mixture is agitated with a homogenizer, thereby producing an O/W emulsion (D). A rotational speed of the homogenizer and an agitating time by the homogenizer are adjusted so that the magenta dye solution (A) is suspended in water as drops having an average diameter of about 4.5 μm.

The solution (C) is added to and mixed with the emulsion (D), and the mixture is slowly agitated at a temperature of 30° C. During the agitation, a suitable amount of 20 wt. % acetic acid aqueous solution is added to the mixture to control the pH in a range of pH3 to pH6. Then, the mixture is heated to a temperature of 60° C. for carrying out a condensation polymerization reaction while agitating the mixture for about one hour, resulting in the production of microcapsules 18 having an average diameter of about 5 to 6 μm. Thereafter, a suitable amount of titanium oxide powder, having an average diameter of about 0.1 μm, is added to the mixture in which the produced microcapsules 18 are dispersed, and the titanium dioxide is electostatically adhered to a shell of each microcapsule 18, whereby the shell is colored white.

The produced microcapsules 18 feature a thickness of the shell wall such that each microcapsule 18 is squashed and broken when being subjected to the pressure of higher than about 0.2 MPa, with a shearing force. The thickness of the shell wall mainly depends on the amount of melamine contained in the melamine-formalin prepolymer aqueous solution (C). Namely, the larger the amount of melamine, the thicker the shell wall.

To produce the heat-sensitive color-developing layer 14, an aqueous compound A is prepared, composed as shown in the following table:

| COMPOSITIONS | PARTS BY WEIGHT |
|---|---|
| (1) 25 wt. % microcapsule aqueous dispersion | 1.0 |
| (2) 17 wt. % Blue-220 aqueous dispersion | 0.2 |
| (3) 17 wt. % OBD aqueous dispersion | 0.2 |
| (4) 20 wt. % K-5 aqueous dispersion | 1.0 |
| (5) 17 wt. % acetoacetic anilide aqueous dispersion | 0.5 |
| (6) 20 wt. % PVA aqueous solution | 0.5 |

Herein:

The composition (1) is prepared by mixing 25 wt. % of the microcapsules 18 with purified water;

The composition (2) is prepared by mixing 17 wt. % of Blue-220 (cyan-developing leuco-pigment) with purified water, Blue-220 being a powder having an average diameter of less than 1 μm;

The composition (3) is prepared by mixing 17 wt. % of OBD (black-developing leuco-pigment) with purified water, OBD also being a powder having an average diameter of less than 1 μm;

The composition (4) is prepared by mixing 20 wt. % of K-5 (color developer) with purified water;

The composition (5) is prepared by mixing 17 wt. % of acetoacetic anilide (sensitizer) with purified water; and The composition (6) is prepared by dissolving 20 wt. % of polyvinyl alcohol (PVA) in purified water, PVA exhibiting a polymerization degree of 500.

The paper sheet 12 is coated with the aqueous compound A at about 4 to 6 g per square meter, and then the coated layer is allowed to dry naturally, resulting in production of the heat-sensitive color-developing layer 14, and therefore, the multi-color image-forming medium 10.

Since the color-developing layer 14 contains acetoacetic anilide (sensitizer), the melting point of the color developer component (K-5) is lowered to about 90° C., the color-developing temperature of the cyan-developing leuco-pigment component (Blue-220) is lowered to about 120° C., and the color-developing temperature of the black-developing leuco-pigment component (ODB) is lowered to about 180° C. The inclusion of acetoacetic anilide may be suitably varied to thereby regulate the melting point of the color developer component and the color-developing temperatures of the cyan- and black-developing leuco-pigment components "□" and "○". Note, polyvinyl alcohol (PVA) serves as a binder for adhered the color developer component and the leuco-pigment component to each other and the color-developing layer 14 to the sheet paper 12.

Figure 2:
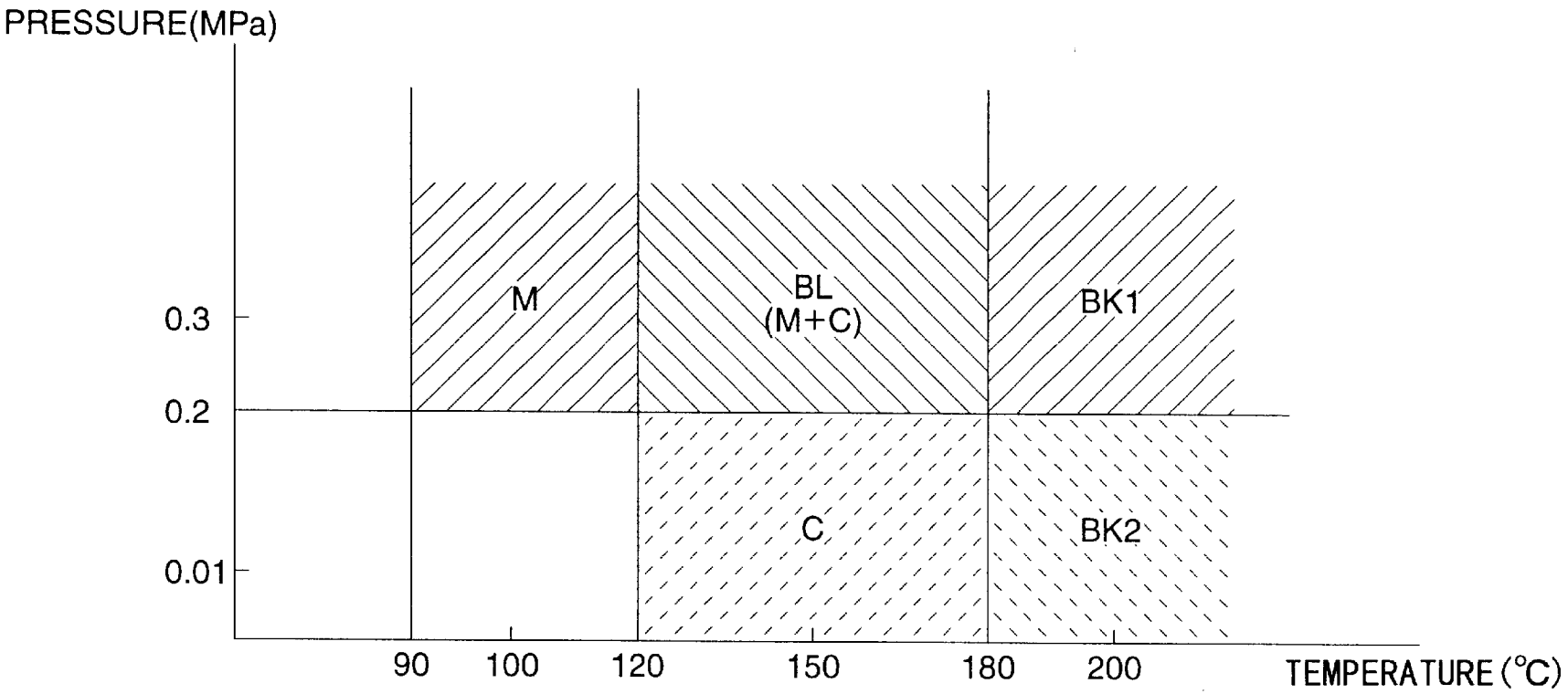
FIG. 2 is a graph showing a multi-color-developing characteristic of the first embodiment shown in FIG. 1.

The multi-color image-forming medium 10 features a color-developing characteristic as shown in a graph of FIG. 2. Namely, as shown in this graph, a magenta-developing area M, a cyan-developing area C, a blue-developing area BL (M+C), a first black-developing area BK1, and a second black-developing area BK2 are defined with respect to the multi-color image-forming medium 10. Thus, as stated in detail hereinafter, using a conventional thermal printing head, it is possible to selectively produce a magenta dot, a cyan dot, a blue dot and a black dot on the color-developing layer 14 of the image-forming medium 10 by suitably regulating a pressure and a temperature to be exerted on the color-developing layer 14.

Figure 3:
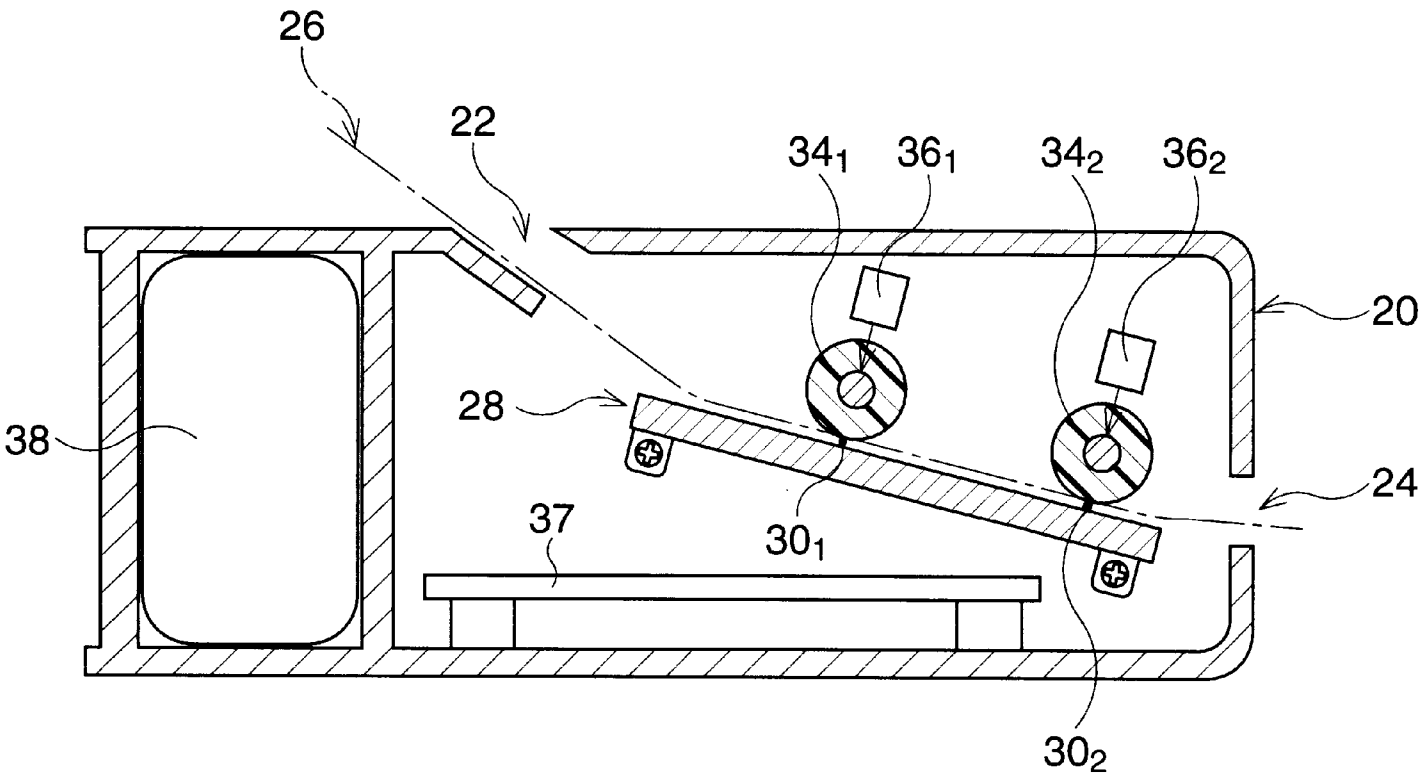
FIG. 3 is a schematic cross-sectional view of a line type printer for forming a multi-color image on the image-forming medium shown in FIG. 1.

FIG. 3 schematically shows a multi-color printer, which is constituted as a line printer to form a multi-color image on the image-forming medium 10.

The printer comprises a rectangular parallelepiped housing 20 having-an entrance opening 22 and an exit opening 24 formed in a top wall and a side wall of the housing 20, respectively. The image-forming medium 10 is introduced into the housing 20 through the entrance opening 22, and is then discharged from the exit opening 24 after the formation of a multi-color image on the image-forming medium 10. Note, in FIG. 3, a path 26 for movement of the image-forming medium 10 is represented by a single-chained line.

A guide plate 28 is provided in the housing 20 to define a part of the path 26 for the movement of the image-forming medium 10, and a first thermal printer head $\mathbf{30}_1$ and a second thermal printer head $\mathbf{30}_2$ are securely attached to a surface of the guide plate 28. Each thermal printing head ($\mathbf{30}_1$, $\mathbf{30}_2$) is formed as a line thermal printing head perpendicularly extended with respect to a direction of the movement of the image-forming medium 10. The first thermal printing head $\mathbf{30}_1$ is utilized to produce a magenta dot and/or a blue dot on the color-developing layer 14, and the second thermal printing head $\mathbf{30}_2$ is utilized to produce a cyan dot and/or a black dot on the color-developing layer 14.

Figure 4:
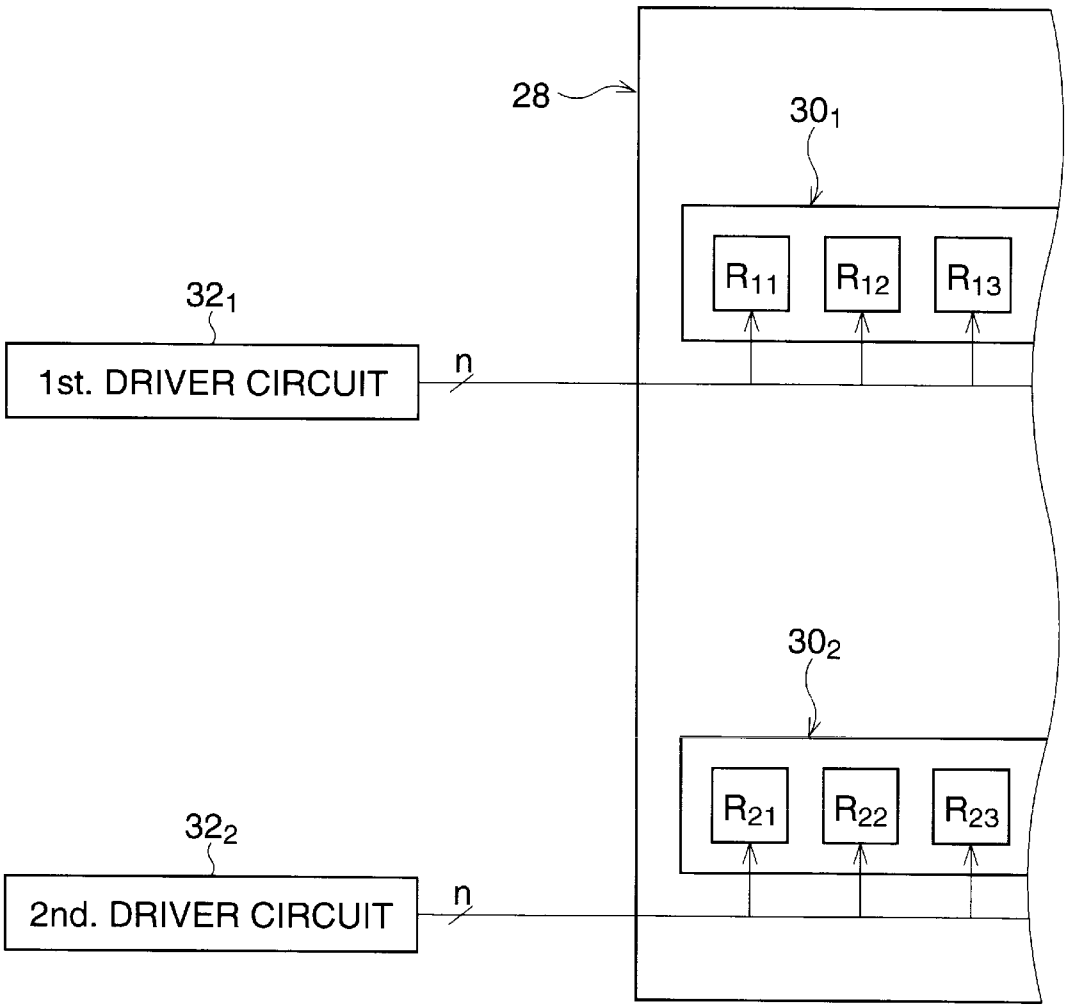
FIG. 4 is a partial schematic block diagram showing first and second thermal printing heads and first and second driver circuits thereof, incorporated in the printer shown in FIG. 3.

As shown in FIG. 4, the first thermal printing head $\mathbf{30}_1$ includes a plurality of heater elements or electric resistance elements $R_{11}$ to $R_{1n}$ only the elements $R_{11}$, $R_{12}$ and $R_{13}$ of which are visible in FIG. 4, the second thermal printing head $\mathbf{30}_2$ includes a plurality of heater elements or electric resistance elements $R_{21}$ to $R_{2n}$, only the elements $R_{21}$, $R_{22}$ and $R_{23}$ of which are visible in FIG. 4. The elements $R_{11}$ to $R_{in}$ are aligned with each other along a length of the first thermal printing head $\mathbf{30}_1$, and the elements $R_{21}$ to $R_{2n}$ are aligned with each other along a length of the second thermal printing head $\mathbf{30}_2$ Further, the respective elements $R_{11}$ to $R_{1n}$ are correspondingly aligned with the elements $R_{21}$ to $R_{2n}$. In short, both the resistance elements $R_{11}$ to $R_{1n}$ and the resistance elements $R_{21}$ to $R_{2n}$ are arranged in a 2×n matrix manner.

As shown in FIG. 4, the resistance elements $R_{11}$ to $R_{1n}$ are connected to a first driver circuit $\mathbf{32}_1$, and are selectively energized by the first driver circuit $\mathbf{32}_1$ in accordance with a single-line of magenta pixel signals and/or a single-line of blue pixel signals. In particular, when any one of the resistance elements $R_{11}$ to $R_{1n}$ is energized in accordance with a magenta pixel signal, the resistance element concerned is heated to a temperature of about 100° C., and when any one of the resistance elements $R_{11}$ to $R_{1n}$ is energized in accordance with a blue pixel signal, the resistance element concerned is heated to a temperature of about 150° C.

Similarly, the electric resistance elements $R_{21}$ to $R_{2n}$ are connected to a second driver circuit $\mathbf{32}_2$, and are selectively energized by the second driver circuit $\mathbf{32}_2$ in accordance with a single-line of cyan pixel signals and/or a single-line of black pixel signals. In particular, when any one of the resistance elements $R_{21}$ to $R_{2n}$ is energized in accordance with a cyan pixel signal, the resistance element concerned is heated to a temperature of about 150° C., and when any one of the resistance elements $R_{21}$ to $R_{2n}$ is energized in accordance with a black pixel signal, the resistance element concerned is heated to a temperature of about 200° C.

As shown in FIG. 3, the first and second thermal printing heads $\mathbf{30}_1$ and $\mathbf{30}_2$ are associated with a first roller platen $\mathbf{34}_1$ and a second roller platen $\mathbf{34}_2$, respectively, and each roller platen ($\mathbf{34}_1$, $\mathbf{34}_2$) is formed of a suitable hard rubber material. The first roller platen $\mathbf{34}_1$ is provided with a first spring-biasing unit $\mathbf{36}_1$ so as to be elastically pressed against the first thermal head $\mathbf{30}_1$ at a pressure of 0.3 MPa more than the critical breaking-pressure of 0.2 MPa of the pressure-sensitive microcapsules 18. The second roller platen $\mathbf{34}_2$ is provided with a second spring-biasing unit $\mathbf{36}_2$ so as to be elastically pressed against the second thermal head $\mathbf{30}_2$ at a pressure of 0.01 MPa less than the critical breaking-pressure of 0.2 MPa of the pressure-sensitive microcapsules 18.

In FIG. 3, reference 37 indicates a control circuit board for controlling a printing operation of the printer, and reference 38 indicates an electrical main power source for electrically energizing the control circuit board 37 including the first and second driver circuits $\mathbf{32}_1$ and $\mathbf{32}_2$.

During the printing operation, the roller platens $\mathbf{34}_1$ and $\mathbf{34}_2$ are rotated in a counterclockwise direction (FIG. 3), with a same peripheral speed under control of the control circuit board 37, so that the multi-color image-forming medium 10, introduced into the entrance opening 22, moves toward the exit opening 24 along the path 26. Note, the introduction of the image-forming medium 10 is performed such that the color-developing layer 14 is in direct contact with the thermal printing heads $\mathbf{30}_1$ and $\mathbf{30}_2$.

While the image-forming medium 10 passes between the first thermal printing head $\mathbf{30}_1$ and the first roller platen $\mathbf{34}_1$ without all the electric resistance elements $R_{11}$ to $R_{1n}$ being energized, the color-developing layer 14 of the image-forming medium 10 is subjected to the pressure of 0.3 MPa with the shearing force from each electric resistance element ($R_{11}$, . . . , $R_{1n}$) of the first thermal printing head $\mathbf{30}_1$, which is higher than the critical breaking-pressure of 0.2 MPa of the microcapsules 18. Nevertheless, the pressure of 0.3 MPa with the shearing force cannot be exerted on the microcapsules 18 due to the solid phase of the color-developing layer 14, and thus the microcapsules 18 are prevented from being squashed and broken.

Figure 5:
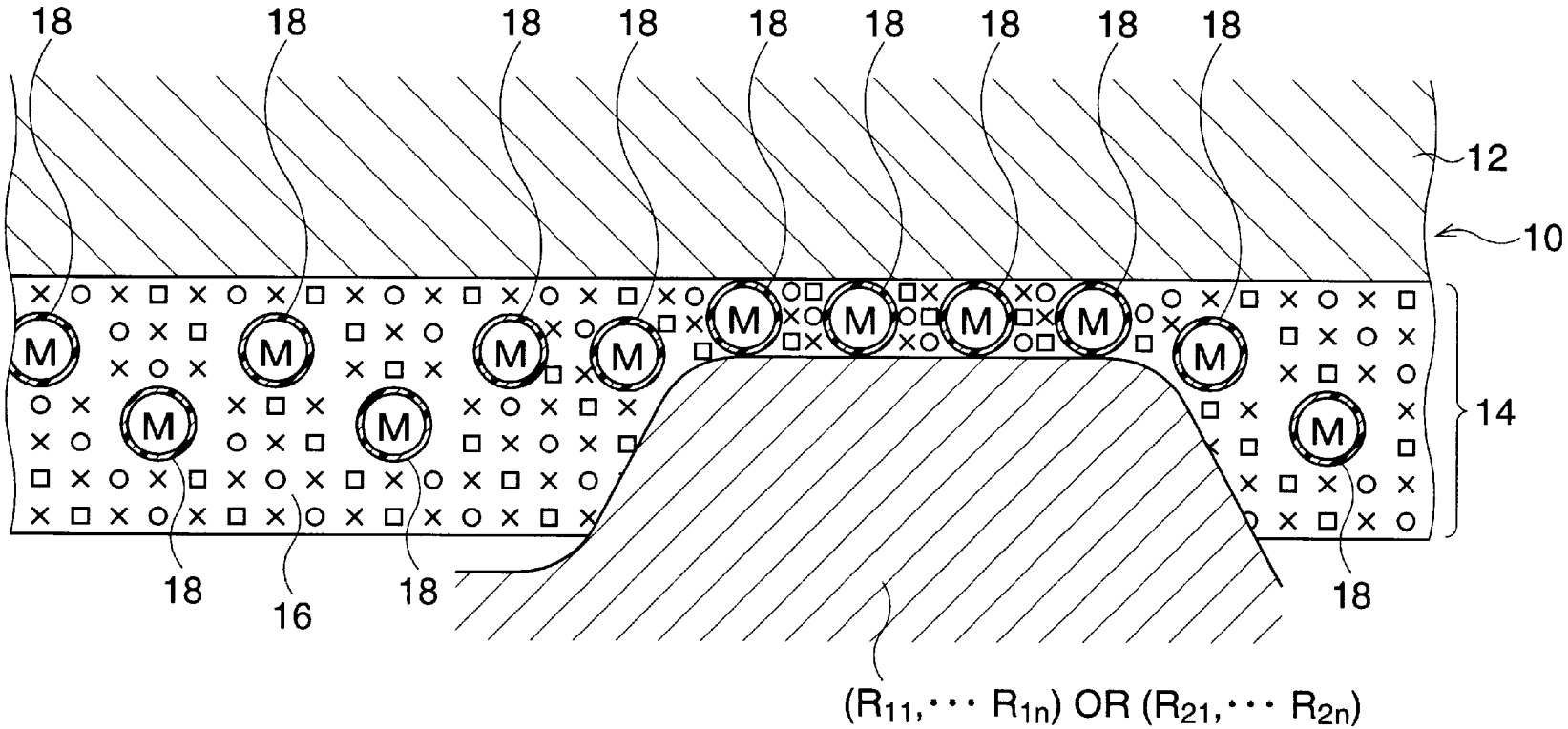
FIG. 5 is a schematic cross-sectional view showing penetration of an electric resistance element of the first or second thermal printing head to thereby develop either a magenta dot, a blue dot, a cyan dot or a black dot on the image-forming medium shown in FIG. 1.

However, when any one of the electric resistance elements $R_{11}$ to $R_{1n}$ is energized in accordance with either a magenta pixel signal or a blue pixel signal, the resistance element concerned is heated to a temperature of at least 100° C. higher than the melting point 90° C. of the color developer component "X". Namely, when the energization is based on the magenta pixel signal, the heating temperature of the resistance element is about 100° C., and when the energization is based on the blue pixel signal, the heating temperature of the resistance element is about 150° C. Thus, the heated resistance element ($R_{11}$, . . . , $R_{1n}$) penetrates into the color-developing layer 14, as shown in FIG. 5 by way of example, due to the thermal fusion of the color developer component "X". Accordingly, the pressure-sensitive microcapsules 18, included in the penetrated area of the color-developing layer 14, are directly subjected to the pressure 0.3 MPa, with the shearing force, from the heated element ($R_{11}$, . . . , $R_{1n}$) and are thus squashed and broken, resulting in discharge of the magenta dye from the broken microcapsules 18. When the energization of the element is based on the magenta pixel signal, a magenta dot is produced on the color-developing layer 14, because only magenta is developed due to the heating temperature of the element being 100° C. less than the color-developing temperature (120° C.) of the cyan-developing leuco-pigment component "□". Also, when the energization of the element is based on the blue pixel signal, a blue dot is produced on the color-developing layer 14, because both magenta and cyan are developed due to the heating temperature of the element being 150° C. more than the color-developing temperature (120° C.) of the cyan-developing leuco-pigment component "□".

On the other hand, while the image-forming medium 10 passes between the second thermal printing head $\mathbf{30}_2$ and the second roller platen $\mathbf{34}_2$, the color-developing layer 14 of the image-forming medium 10 is subjected to a pressure of 0.01 MPa with the shearing force from each electric resistance element ($R_{21}$, . . . , $R_{2n}$) of the second thermal printing head $\mathbf{30}_2$, which is considerably lower than the critical breaking-pressure of 0.2 MPa of the microcapsules 18. Also, when any one of the electric resistance elements $R_{21}$ to $R_{2n}$ is energized in accordance with either a cyan pixel signal or a black pixel signal, the resistance element concerned is heated to a temperature of at least 150° C. Namely, when the energization is based on the cyan pixel signal, the heating temperature of the element is about 150° C., and when the energization is based on the black pixel signal, the heating temperature of the resistance element is about 200° C.

Thus, although the heated element ($R_{21}$, . . . , $R_{2n}$) penetrates into the color-developing layer 14 (FIG. 5) due to the thermal fusion of the color developer component "X", the microcapsules 18, included in the penetrated area of the color-developing layer 14, cannot be squashed and broken, because the pressure of 0.01 MPa, to which the microcapsules 18 are subjected by each resistance element ($R_{21}$, . . . , $R_{2n}$) of the second thermal printing head $\mathbf{30}_2$, is considerably lower than the critical breaking-pressure of 0.2 MPa for the microcapsules 18. In short, none of the microcapsules 18 can be squashed and broken while the image-forming medium 10 passes between the second thermal printing head $\mathbf{30}_2$ and the second roller platen $\mathbf{34}_2$.

In the second thermal printing head $\mathbf{30}_2$, when the energization of the element is based on the cyan pixel signal, a cyan dot is produced on the color-developing layer 14, because only cyan is developed as the heating temperature of the element is 150° C. less than the color-developing temperature (180° C.) of the black-developing leuco-pigment component "○". Also, when the energization of the element is based on the black pixel signal, a black dot is produced on the color-developing layer 14, because black is developed as the heating temperature of the element is 200° C. more than the color-developing temperature (180° C.) of the black-developing leuco-pigment component "○". Of course, during the production of the black dot, although the cyan is also developed, the developed cyan is absorbed by the black dot.

Of course, in this embodiment, the production of the black dot by the second thermal printing head $\mathbf{30}_2$ is based on the second black-developing area BK2 of the color-developing characteristic shown in the graph of FIG. 2. Optionally, it is possible to produce a black dot by the first thermal printing head $\mathbf{30}_1$ on the basis of the first black-developing area BK1. Namely, when any one of the resistance elements ($R_{11}$ to $R_{1n}$) is energized in accordance with a black pixel signal to be heated to the temperature of 200° C., a black dot is produced on the color-developing layer 14. In this case, although magenta and cyan are also developed, both the developed magenta and cyan are absorbed by the black dot.

Note, a dot size (diameter) of the magenta, blue, cyan and black dots corresponds to a size of the resistance elements ($R_{11}$, . . . , $R_{1n}$; $R_{21}$, . . . , $R_{2n}$), and may be from about 50 to 100 $\mu$m.

As is apparent from the foregoing, using the printer as shown in FIGS. 3 and 4, it is possible to form a multi-color image on the color-developing layer 14 of the medium 10 by driving the first thermal printing head $\mathbf{30}_1$ in accordance with a frame of magenta pixel signals and/or a frame of blue pixel signals, and by driving the second thermal printing head $\mathbf{30}_2$ in accordance with a frame of cyan pixel signals and/or a frame of black pixel signals.

In the first embodiment, a cyan-developing leuco-pigment and a black-developing leuco-pigment, which can be utilized to form the color-developing layer 14, are very restricted, because the respective cyan-and black-developing leuco-pigment components must exhibit color-developing temperatures of around 120° C. and around 180° C. before the color-developing layer 14 can be featured by the color-developing characteristic as shown in the graph of FIG. 2. However, a magenta pigment, utilized in the microcapsules 18, can be optionally selected without being substantially subjected to any restrictions. Namely, although the magenta dye encapsulated in the microcapsules 18 is based on Rhodamine Lake T, it is possible to utilize another type of magenta pigment, exhibiting a desired tone, to prepare the magenta dye.

In the first embodiment, optionally, a yellow-developing leuco-pigment component may be substituted for the black-developing leuco-pigment component "○". In this case, the first black-developing area BK1 is defined as a black-developing area in which the developed three-primary colors (magenta, cyan and yellow) are mixed to thereby produce black, and the second black-developing area BK1 is defined as a green-developing area in which the developed cyan and yellow are mixed to thereby produce green. Namely, it is possible to develop the five colors, i.e. magenta, cyan, blue, green and black, using the magenta-, cyan- and yellow-developing leuco-pigment components.

In the first embodiment, the color-developing layer 14 may contain only one of the cyan- and black-developing leuco-pigment components "□" and "○". Of course, when the color-developing layer 14 contains only the cyan-developing leuco-pigment component "□", magenta and blue are developed by the first thermal printing head $\mathbf{30}_1$, and cyan is developed by the second thermal printing head $\mathbf{30}_2$. Also, when the color-developing layer 14 contains only the black-developing leuco-pigment component "○", magenta and black may be developed by only using the first thermal printing head $\mathbf{30}_1$, In the first embodiment, a magenta dye to be encapsulated in the microcapsules 18 may be composed of the transparent oil (KMC-113), and a suitable magenta-developing leuco-pigment optionally selected from among various types of magenta-developing leuco-pigment without being restricted by a color-developing temperature thereof. When the magenta dye is seeped from a broken microcapsule 18, the magenta-developing leuco-pigment component contained in the magenta dye immediately reacts with the color developer regardless of the color-developing temperature thereof, because the magenta-developing leuco-pigment is dissolved in the transparent oil (KMC-113). If a desired tone cannot be obtained by only a single-type of magenta-developing leuco-pigment, it is possible to mix more than two types of magenta-developing leuco-pigment, to thereby obtain a mixture of magenta-developing leuco-pigments exhibiting the desired tone.

Figure 6:
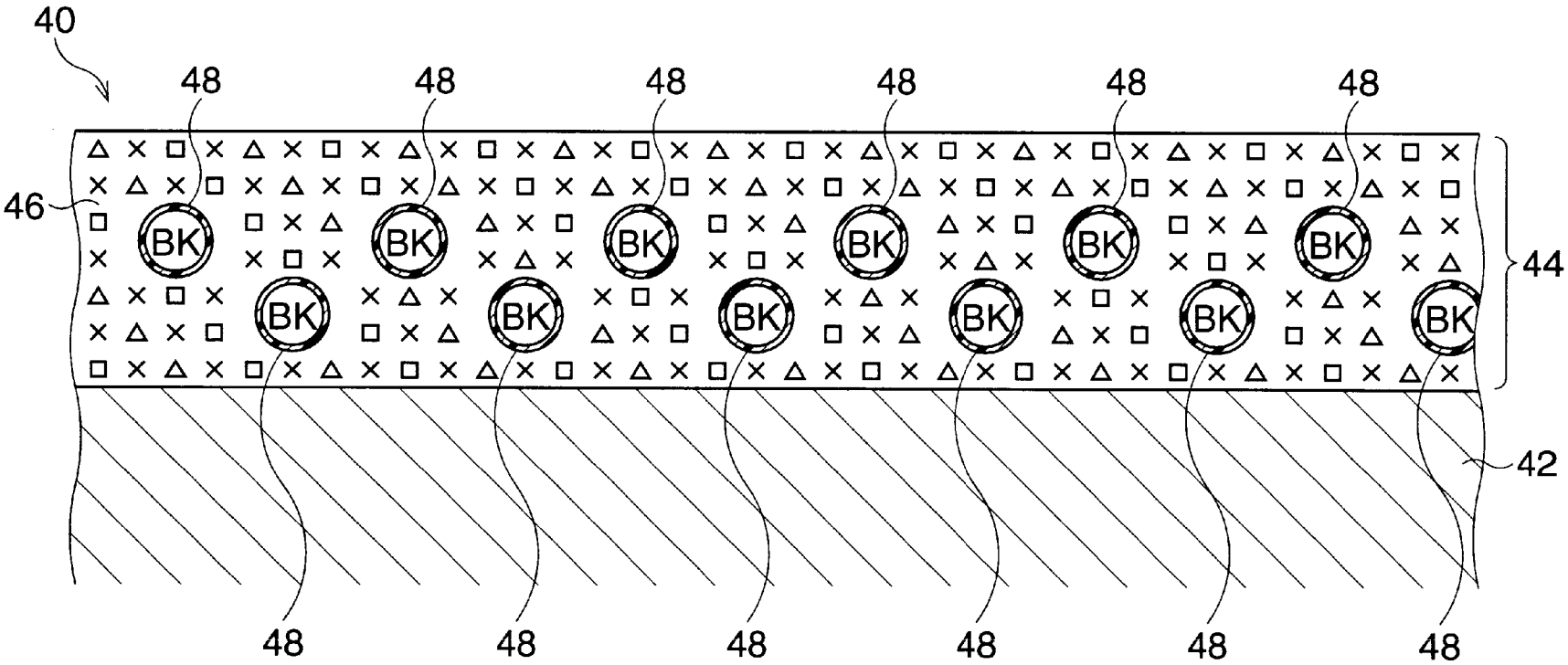
FIG. 6 is a schematic conceptual cross-sectional view showing a second embodiment of a multi-color image-forming medium, according to the present invention.

FIG. 6 schematically shows a second embodiment of a multi-color image-forming medium, generally indicated by reference numeral 40, according to the present invention. Similar to the first embodiment, the image-forming medium 40 comprises a sheet of paper 42, and a color-developing layer 44 coated thereon. The color-developing layer 44 is also formed as a heat-sensitive color-developing layer 46 containing a plurality of pressure-sensitive microcapsules 48 uniformly distributed therein. The heat-sensitive color-developing layer 46 is composed of a first leuco-pigment component represented by symbols "□", a second leuco-pigment component represented by symbols "Δ", and a color developer component represented by symbols "X".

Similar to the first embodiment, the first leuco-pigment component "□" is composed of Blue-220, and the color developer component "X" is composed of K-5. The second leuco-pigment component "Δ" is composed of a magenta-developing leuco-pigment for which Red-3 is utilized. Red-3 is available from YAMAMOTO KASEI K. K., and exhibits a melting point of about 210° C., substantially equivalent to a color-developing temperature thereof. Although not showing in FIG. 6, the heat-sensitive color-developing layer 46 contains a suitable amount of acetoacetic anilide which serves as a sensitizer for regulating the color-developing temperature of the leuco-pigment components "□" and "Δ" and the melting point of the color developer component "X".

The pressure-sensitive microcapsules 48 are filled with a black ink or dye exhibiting a given tone required by a user.

In the second embodiment, the black dye is composed of a transparent liquid vehicle, and a black pigment dispersed or dissolved in the vehicle. For the liquid vehicle, KMC-113 is utilized, and for the black pigment, ODB (black-developing leuco-pigment) is utilized. The black dye is prepared by dissolving 4 wt. % OBD in KMC-113. Note, in FIG. 6, the black dye, contained in each pressure-sensitive microcapsule 48, is represented by the first and last capital letters "BK" of black.

Similar to the first embodiment, the shell wall of each pressure-sensitive microcapsule 48 is formed of a melamine resin, but the melamine resin is not colored because the black dye, encapsulated in each microcapsule 48, is transparent. Also, the microcapsules 48 have an average diameter of about 5 to 6 $\mu$m, and the shell wall of each microcapsule 48 has a thickness such that each microcapsule 48 is squashed and broken when being subjected to a pressure of higher than about 0.2 MPa, with a shearing force. Namely, the microcapsules 48 may be produced in substantially the same manner as the microcapsules 18.

To produce the heat-sensitive color-developing layer 44, an aqueous compound B is prepared, composed as shown in the following table:

| COMPOSITIONS | PARTS BY WEIGHT |
|---|---|
| (1) 25 wt. % microcapsule aqueous dispersion | 1.0 |
| (2) 17 wt. % Blue-220 aqueous dispersion | 0.2 |
| (3) 17 wt. % Red-3 aqueous dispersion | 0.2 |
| (4) 20 wt. % K-5 aqueous dispersion | 1.0 |
| (5) 17 wt. % acetoacetic anilide aqueous dispersion | 0.5 |
| (6) 20 wt. % PVA aqueous solution | 0.5 |

Note that the aqueous compound B is essentially identical to the aforementioned aqueous compound A except that the composition (1) is prepared by mixing 25 wt. % of the microcapsules 48 with purified water, and that the composition (3) is prepared by mixing 17 wt. % of Red-3 (magenta-developing leuco-pigment) with purified water, Red-3 being a powder having an average diameter of less than 1 $\mu$m.

The paper sheet 42 is coated with the aqueous compound B at about 4 to 6 g per square meter, and then the coated layer is allowed to naturally dry, resulting in production of the heat-sensitive color-developing layer 44, and therefore, the multi-color image-forming medium 40.

Similar to the first embodiment, due to the inclusion of acetoacetic anilide, the melting point of the color developer component (K-5) is lowered from 145° C. to about 90° C., the color-developing temperature of the cyan-developing leuco-pigment component (Blue-220) is lowered to about 120° C., and the color-developing temperature of the magenta-developing leuco-pigment component (Red-3) is lowered to about 180° C.

Figure 7:
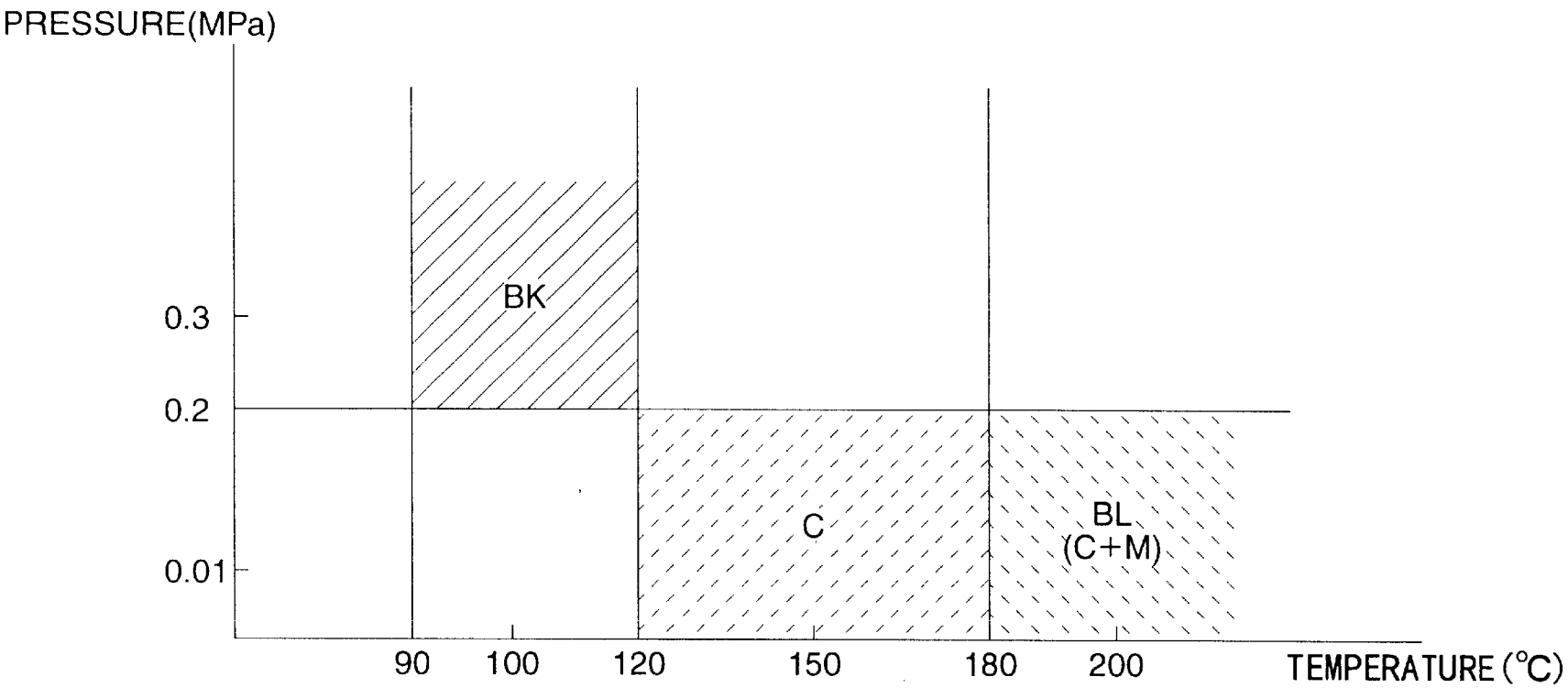
FIG. 7 is a graph showing a multi-color-developing characteristic of the second embodiment shown in FIG. 6.

The multi-color image-forming medium 40 features a color-developing characteristic as shown in a graph of FIG. 7. Namely, as shown in this graph, a black-developing area BK, a cyan-developing area C and a blue-developing area BL (C+M) are defined with respect to the multi-color image-forming medium 40. Thus, using the printer as shown in FIGS. 3 and 4, it is possible to selectively produce a black dot, a cyan dot and a blue dot on the color-developing layer 44 of the image-forming medium 40 in substantially the same manner as in the first embodiment.

In particular, during the passage of the image-forming medium 40 between the first thermal printing head $\mathbf{30}_1$ and the first roller platen $\mathbf{34}_1$, when any one of the electric resistance elements $R_{11}$ to $R_{1n}$ is energized in accordance with a black pixel signal, the resistance element concerned is heated to a temperature of 100° C. higher than the melting point 90° C. of the color developer component "X". Accordingly, the heated resistance element ($R_{11}, \ldots, R_{1n}$) penetrates into the color-developing layer 44, due to the thermal fusion of the color developer component "X", whereby the microcapsules 48, included in the penetrated area of the color-developing layer 44, are directly subjected to the pressure 0.3 MPa, with the shearing force, from the heated element ($R_{11}, \ldots, R_{1n}$), and are thus squashed and broken, resulting in discharge of the black dye from the broken microcapsules 48. In short, a black dot is produced on the color-developing layer 44.

On the other hand, during the passage of the image-forming medium 40 between the second thermal printing head $\mathbf{30}_2$ and the second roller platen $\mathbf{34}_2$, when any one of the electric resistance elements $R_{21}$ to $R_{2n}$ is energized in accordance with either a cyan pixel signal or a blue pixel signal, the element concerned is heated to a temperature of at least 150° C. Namely, when the energization is based on the cyan pixel signal, the heating temperature of the element is about 150° C., and when the energization is based on the blue pixel signal, the heating temperature of the element is about 200° C. Although the heated element ($R_2, \ldots, R_{2n}$) penetrates into the color-developing layer 44, due to the thermal fusion of the color developer component "X", the microcapsules 48, included in the penetrated area of the color-developing layer 44, cannot be squashed and broken, due to the low pressure of 0.01 MPa.

When the energization of the element is based on the cyan pixel signal, a cyan dot is produced on the color-developing layer 44, because only cyan is developed as the heating temperature of the element concerned is 150° C. less than the color-developing temperature (180° C.) of the magenta-developing leuco-pigment component "Δ". Also, when the energization of the element is based on the blue pixel signal, a blue dot is produced on the color-developing layer 44, because both cyan and magenta are developed as the heating temperature of the element is 200° C. more than the color-developing temperature (180° C.) of the magenta-developing leuco-pigment component "Δ".

According to the second embodiment, when black is developed on the color-developing layer 44, neither cyan or magenta can be developed. Namely, since the developed black is prevented from being mixed with either cyan or magenta, it is possible to obtain the black dot as a pure or vivid black dot. Thus, the multi-color image-forming medium 40 is especially superior when utilized for, for example, business documents in which characters are recorded with black, and in which graphs, tables, illustrations and so on are recorded with cyan and/or magenta.

Note that the various changes and modifications of the first embodiment may be applied to the second embodiment, where possible.

Figure 8:
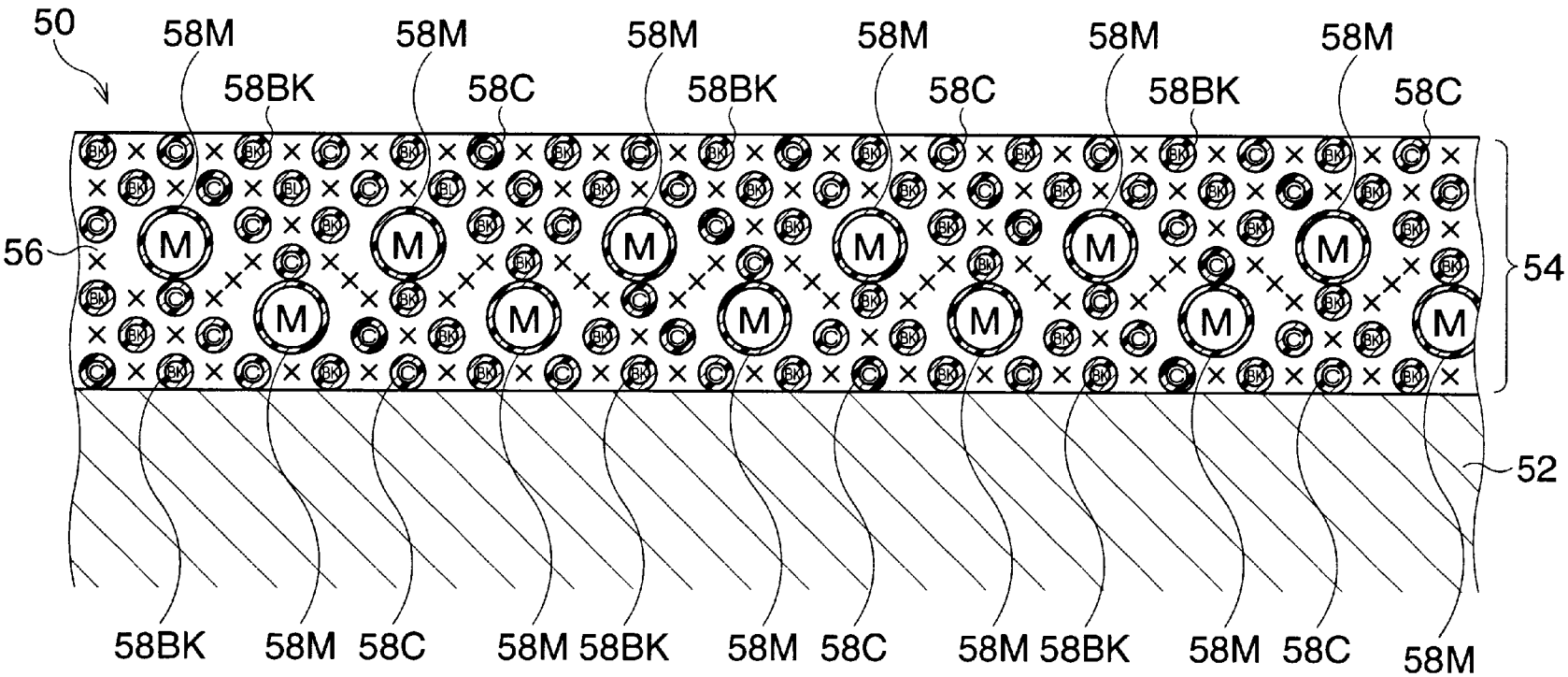
FIG. 8 is a schematic conceptual cross-sectional view showing a third embodiment of a multi-color image-forming medium, according to the present invention.

FIG. 8 schematically shows a third embodiment of a multi-color image-forming medium, generally indicated by reference numeral 50, according to the present invention. Similar to the aforementioned embodiments, the multi-color image-forming medium 50 comprises a sheet of paper 52, and a color-developing layer 54 coated thereon. In the third embodiment, the color-developing layer 54 is constituted as a color developer layer 56 containing plurality of heat-sensitive microcapsules 58C, a plurality of heat-sensitive microcapsules 58BK and a plurality of pressure-sensitive microcapsules 58M uniformly distributed therein. The color developer layer 56 is composed of a color developer component, such as K-5, represented by symbols "X". Note, in the third embodiment, the color developer component "X" and the heat-sensitive microcapsules 58C and 58BK define a heat-sensitive color-developing layer.

The pressure-sensitive microcapsules 58M are essentially identical to the pressure-sensitive microcapsules 18 utilized in the first embodiment. Namely, the microcapsules 58M are filled with the magenta ink or dye composed of the transparent oil (KMC-113) and Rhodamine Lake T dispersed or dissolved therein, and have an average diameter of about 5 to 6 $\mu$m. Also, the shell wall of each microcapsule 58M has a thickness such that each microcapsule 58M is squashed and broken when being subjected to a pressure of higher than about 0.2 MPa, with a shearing force.

The heat-sensitive microcapsules 58C are filled with a cyan-developing leuco-pigment for which Blue-220 is utilized. Namely, Blue-220 is encapsulated as a powder in the microcapsules 58C. Each of the microcapsules 58C is constituted to be thermally broken at a temperature of more than about 120° C. To this end, a shell wall of each microcapsule 58C is formed of either a suitable thermoplastic resin, such as polyurethane, polyurea, polyamide or the like, or a suitable wax, such as olefin wax or the like, which is thermally plasticized or fused at a temperature of more than about 120° C. Of course, when the shell wall of each microcapsule 58C is thermally broken, the cyan-developing leuco-pigment reacts with the color developer component "X", resulting in development of cyan. Namely, the heat-sensitive microcapsules 58C exhibit a color-developing characteristic that develops cyan when being heated to the temperature of more than about 120° C. Note, in FIG. 8, the cyan-developing leuco-pigment, contained in each microcapsule 58C, is represented by the first capital letter "C" of cyan.

The heat-sensitive microcapsules 58BK are filled with a black-developing pigment for which ODB is utilized. Namely, ODB is encapsulated as a powder in the microcapsules 58BK. Each of the microcapsules 58BK is constituted to be thermally broken at a temperature of more than about 180° C. To this end, a shell wall of each microcapsule 58BK is formed of a suitable thermoplastic resin, such as polyamide, polyurea or the like, that is thermally plasticized or fused at the temperature of more than about 180° C. Of course, when the shell wall of each microcapsule 58BK is thermally broken, the black-developing leuco-pigment reacts with the color developer component "X", resulting in development of black. Namely, the heat-sensitive microcapsules 58BK exhibit a color-developing characteristic that develops black when being heated to the temperature of more than about 180° C. Note, in FIG. 8, the black-developing leuco-pigment, contained in each microcapsule 58BK, is represented by the first and last capital letters "BK" of black.

The heat-sensitive microcapsules 58C and 58BK have an average diameter of about 3 $\mu$m. Also, the cyan microcapsules 58C can endure a pressure of 0.3 MPa at temperatures less than about 120° C., and the black microcapsules 58BK can endure a pressure of 0.3 MPa at temperatures less than about 180° C. Note, the heat-sensitive microcapsules 58C and 58BK may be produced by an interfacial polymerization method, a coacervation method, a spray drying method and so on.

To produce the color-developing layer 54, an aqueous compound C is prepared, composed as shown in the following table:

| COMPOSITIONS | PARTS BY WEIGHT |
|---|---|
| (1) 25 wt. % microcapsule aqueous dispersion (58M) | 0.3 |
| (2) 25 wt. % microcapsule aqueous dispersion (58C) | 0.3 |
| (3) 25 wt. % microcapsule aqueous dispersion (58BK) | 0.3 |
| (4) 20 wt. % K-5 aqueous dispersion | 1.0 |
| (5) 17 wt. % acetoacetic anilide aqueous dispersion | 0.5 |
| (6) 20 wt. % PVA aqueous solution | 0.5 |

Herein:

The composition (1) is prepared by mixing 25 wt. % of the magneta microcapsules 58M with purifide water;

The composition (2) is prepared by mixing 25 wt. % of the cyan microcapsules 58C with purified water;

The composition (3) is prepared by mixing 25 wt. % of the black microcapsules 58BK with purified water; and The compositions (4), (5) and (6) are essentially identical to those of the aqueous compound A of the first embodiment.

The paper sheet 52 is coated with the aqueous compound C at about 4 to 6 g per square meter, and then the coated layer is allowed to dry naturally, resulting in production of the color-developing layer 54, and therefore, the multi-color image-forming medium 50.

Similar to the first embodiment, due to the inclusion of acetoacetic anilide, the melting point of the color developer component (K-5) is lowered from 145° C. to about 90° C., color-developing temperature of the cyan-developing leuco-pigment (Blue-220) is lowered to about 120° C., and the color-developing temperature of the black-developing leuco-pigment component (ODB) is lowered to about 180° C.

Accordingly, a color-developing characteristic of the multi-color image-forming medium 50 is essentially identical to that of the first embodiment (FIG. 2), and thus it is possible to record a multi-color image on the color-developing layer 54, using the printer as shown in FIGS. 3 and 4, in substantially the same manner as on the multi-color image-forming medium 10.

In particular, during the passage of the image-forming medium 50 between the first thermal printing head $\mathbf{30}_1$ and the first roller platen $\mathbf{34}_1$ when any one of the electric resistance elements $R_{11}$ to $R_{1n}$ is energized in accordance with either a magenta pixel signal or a blue pixel signal, the resistance element concerned is heated to a temperature of at least 100° C. higher than the melting point 90° C. of the color developer component "X". Namely, when the energization is based on the magenta pixel signal, the heating temperature of the element is about 100° C., and when the energization is based on the blue pixel signal, the heating temperature of the element is about 150° C. Thus, the heated resistance element ($R_{11}$, . . . , $R_{1n}$) penetrates into the color-developing layer 54, due to the thermal fusion of the color developer component "X".

Accordingly, the pressure-sensitive microcapsules 58M, included in the penetrated area of the color-developing layer 54, are directly subjected to the pressure 0.3 MPa, with the shearing force, from the heated element ($R_{11}$, . . . , $R_{1n}$), and are thus squashed and broken, resulting in discharge of the magenta dye from the broken microcapsules 58M. When the energization of the element is based on the magenta pixel signal, a magenta dot is produced on the color-developing layer 54, because only magenta is developed as the heating temperature of the element concerned is 100° C. less than the breakage temperature (120° C.) of the cyan microcapsules 58C. Also, when the energization of the element is based on the blue pixel signal, a blue dot is produced on the color-developing layer 54, because both magenta and cyan are developed as the heating temperature of the element concerned is 150° C. more than the breakage temperature (120° C.) of the cyan microcapsules 58C.

On the other hand, while the image-forming medium 50 passes between the second thermal printing head $\mathbf{30}_2$ and the second roller platen $\mathbf{34}_2$, the color-developing layer 54 of the image-forming medium 50 is subjected to the pressure of 0.01 MPa with the shearing force from each electric resistance element ($R_{21}, \ldots, R_{2n}$) of the second thermal printing head $\mathbf{30}_2$, which is considerably lower than the critical breaking-pressure of 0.2 MPa of the microcapsules 58M. Also, when any one of the electric resistance elements $R_{21}$ to $R_{2n}$ is energized in accordance with either a cyan pixel signal or a black pixel signal, the resistance element concerned is heated to a temperature of at least 150° C. Namely, when the energization is based on the cyan pixel signal, the heating temperature of the element is about 150° C., and when the energization is based on the black pixel signal, the heating temperature of the element is about 200° C.

Thus, although the heated element ($R_{21}, \ldots, R_{2n}$) penetrates into the color-developing layer 54 due to the thermal fusion of the color developer component "X", the microcapsules 58M, included in the penetrated area of the color-developing layer 54, cannot be squashed and broken. In short, none of the microcapsules 58M can be squashed and broken while the image-forming medium 50 passes between the second thermal printing head $\mathbf{30}_2$ and the second roller platen $\mathbf{34}_2$.

In the second thermal printing head $\mathbf{30}_2$, when the energization of the element is based on the cyan pixel signal, a cyan dot is produced on the color-developing layer 54, because only cyan is developed as the heating temperature of the element concerned is 150° C. less than the breakage temperature (180° C.) of the black microcapsule 58BK. Also, when the energization of the element is based on the black pixel signal, a black dot is produced on the color-developing layer 54, because black is developed as the heating temperature of the element is 200° C. more than the breakage temperature (180° C.) of the black microcapsule 58BK. Of course, during the production of the black dot, although the cyan is also developed, the developed cyan is absorbed by the black dot.

Note that the various changes and modifications of the preceding embodiments may be applied to the third embodiment, where possible.

Figure 9:
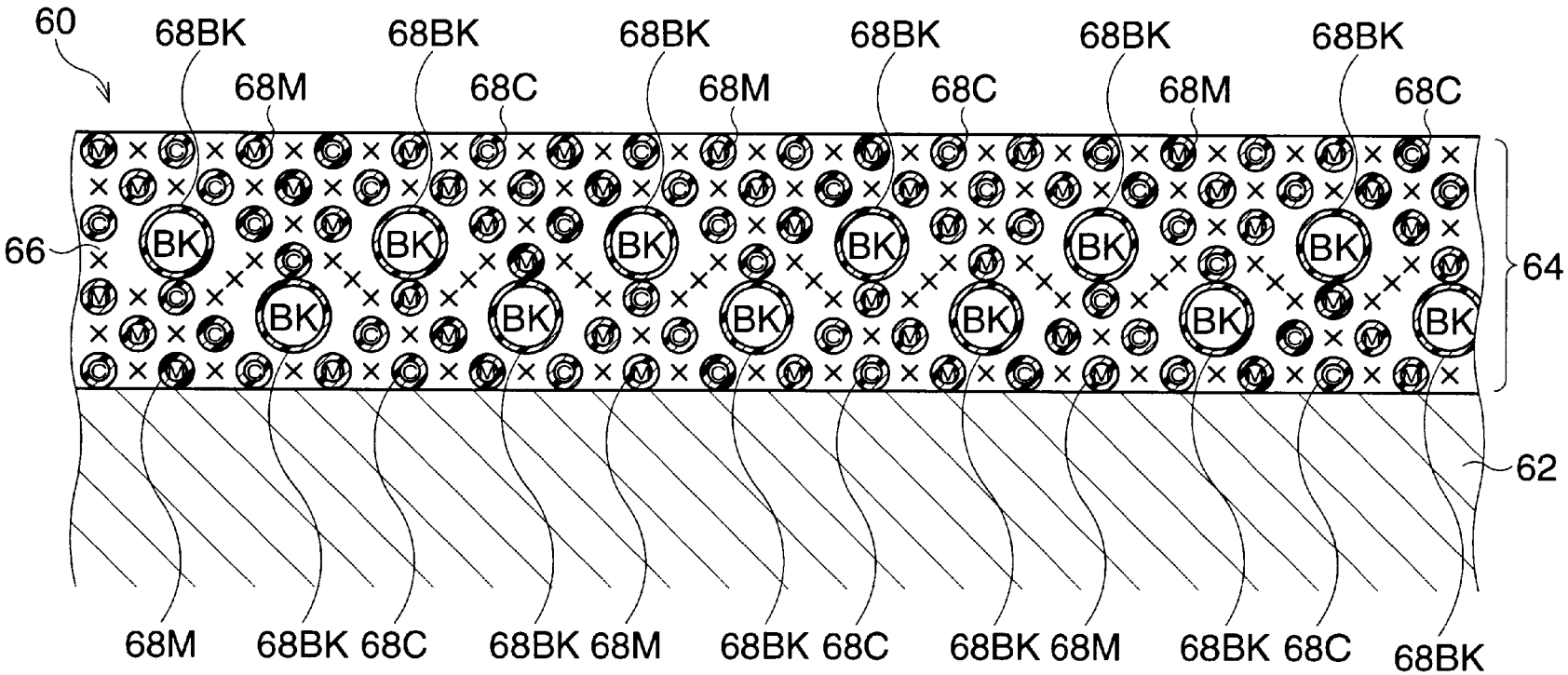
FIG. 9 is a schematic conceptual cross-sectional view showing a fourth embodiment of a multi-color image-forming medium, according to the present invention.

FIG. 9 schematically shows a fourth embodiment of a multi-color image-forming medium, generally indicated by reference numeral 60, according to the present invention. Similar to the aforementioned embodiments, the multi-color image-forming medium 60 comprises a sheet of paper 62, and a color-developing layer 64 coated thereon. In the fourth embodiment, the color-developing layer 64 is constituted as a color developer layer 66 containing a plurality of heat-sensitive microcapsules 68C, a plurality of heat-sensitive microcapsules 68M and a plurality of pressure-sensitive microcapsules 68BK uniformly distributed therein. Similar to the third embodiment, the color developer layer 66 is composed of a color developer component, such as K-5, represented by symbols "X". Note, similar to the third embodiment, in the fourth embodiment, the color developer component "X" and the heat-sensitive microcapsules 68C and 68M define a heat-sensitive color-developing layer.

The pressure-sensitive microcapsules 68BK are essentially identical to the heat-sensitive microcapsules 48 utilized in the second embodiment (FIG. 6). Namely, the microcapsules 68BK are filled with the black ink or dye composed of the transparent oil (KMC-113) and the black-developing leuco-pigment (ODB) dispersed or dissolved therein, and have an average diameter of about 5 to 6 $\mu$m. Also, the shell wall of each microcapsule 68BK has a thickness such that each microcapsule 68BK is squashed and broken when being subjected to a pressure of higher than about 0.2 MPa, with a shearing force.

The heat-sensitive microcapsules 68C are essentially identical to the cyan heat-sensitive microcapsules 58C utilized in the third embodiment. Namely, a cyan-developing leuco-pigment (Blue-220) is encapsulated as a powder in the microcapsules 68C, and each of the microcapsules 68C is constituted to be thermally broken at a temperature of more than about 120° C. Thus, when the shell wall of each microcapsule 68C is thermally broken, the cyan-developing leuco-pigment reacts with the color developer component "X", resulting in development of cyan. Note, in FIG. 9, the cyan-developing leuco-pigment (Blue-220), contained in each microcapsule 68C, is represented by the first capital letter "C" of cyan.

The heat-sensitive microcapsules 68M are filled with a magenta-developing pigment for which Red-3 is utilized. Namely, Red-3 is encapsulated as a powder in the microcapsules 68M. Each of the microcapsules 68M is constituted to be thermally broken at a temperature of more than about 180° C. To this end, a shell wall of each microcapsule 68M is formed of a suitable thermoplastic resin, such as polyamide, polyurea or the like, to be thermally plasticized or fused the temperature of more than about 180° C. Of course, when the shell wall of each microcapsule 68M is thermally broken, the magenta-developing leuco-pigment reacts with the color developer component "X", resulting in development of magenta. Namely, the heat-sensitive microcapsules 68M exhibit a color-developing characteristic that develops magenta when being heated to the temperature of more than about 180° C. Note, in FIG. 9, the magenta-developing leuco-pigment, contained in each microcapsule 68M, is represented by the first capital letter "M" of magenta.

Similar to the third embodiment, the heat-sensitive microcapsules 68C and 68M have an average diameter of about 3 $\mu$m. Also, the cyan microcapsules 68C can endure a pressure of 0.3 MPa at the temperature of less than about 120° C., and the magenta microcapsules 68M can endure a pressure of 0.3 MPa at a temperature of less than about 180° C. Note, of course, the heat-sensitive microcapsules 68M may be produced in the same manner as the heat-sensitive microcapsules 58C and 58B.

To produce the color-developing layer 64, an aqueous compound D is prepared, composed as shown in the following table:

| COMPOSITIONS | PARTS BY WEIGHT |
|---|---|
| (1) 25 wt. % microcapsule aqueous dispersion (68BK) | 0.3 |
| (2) 25 wt. % microcapsule aqueous dispersion (68C) | 0.3 |
| (3) 25 wt. % microcapsule aqueous dispersion (68M) | 0.3 |
| (4) 20 wt. % K-5 aqueous dispersion | 1.0 |

-continued

| COMPOSITIONS | PARTS BY WEIGHT |
|---|---|
| (5) 17 wt. % acetoacetic anilide aqueous dispersion | 0.5 |
| (6) 20 wt. % PVA aqueous solution | 0.5 |

Note that the aqueous compound D is essentially identical to the aqueous compound C except that the respective compositions (1) and (3) are prepared by mixing 25 wt. % of the black pressure-sensitive microcapsules 68BK with purified water, and by mixing 25 wt. % of the magenta heat-sensitive microcapsules 68M with purified water.

The paper sheet 62 is coated with the aqueous compound D at about 4 to 6 g per square meter, and then the coated layer is allowed to dry naturally, resulting in production of the color-developing layer 64, and therefore, the multi-color image-forming medium 60.

Similar to the third embodiment, due to the inclusion of acetoacetic anilide, the melting point of the color developer component (K-5) is lowered from 145° C. to about 90° C., the color-developing temperature of the cyan-developing leuco-pigment (Blue-220) is lowered to about 120° C., and the color-developing temperature of the magenta-developing leuco-pigment component (Red-3) is lowered to about 180° C.

Accordingly, a color-developing characteristic of the multi-color image-forming medium 60 is essentially identical to that of the second embodiment (FIG. 7), and thus it is possible to record a multi-color image on the color-developing layer 64, using the printer as shown in FIGS. 3 and 4, in substantially the same manner as on the multi-color image-forming medium 20.

In particular, during the passage of the image-forming medium 60 between the first thermal printing head $\mathbf{30}_1$ and the first roller platen $\mathbf{34}_1$, when any one of the electric resistance elements $R_{11}$ to $R_{1n}$ is energized in accordance with a black pixel signal, the resistance element concerned is heated to a temperature of 100° C. higher than the melting point 90° C. of the color developer component "X". Accordingly, the heated resistance element ($R_{11}, \ldots, R_{1n}$) penetrates into the color-developing layer 64, due to the thermal fusion of the color developer component "X", whereby the black pressure-sensitive microcapsules 68BK, included in the penetrated area of the color-developing layer 44, are directly subjected to the pressure 0.3 MPa, with the shearing force, from the heated element ($R_{11}, \ldots, R_{1n}$), and are thus squashed and broken, resulting in discharge of the black dye from the broken microcapsules 68BK. In short, a black dot is produced on the color-developing layer 64.

On the other hand, during the passage of the image-forming medium 60 between the second thermal printing head $\mathbf{30}_2$ and the second roller platen $\mathbf{34}_2$, when any one of the electric resistance elements $R_{21}$ to $R_{2n}$ is energized in accordance with either a cyan pixel signal or a blue pixel signal, the element concerned is heated to a temperature of at least 150° C. Namely, when the energization is based on the cyan pixel signal, the heating temperature of the resistance element is about 150° C., and when the energization is based on the blue pixel signal, the heating temperature of the resistance element is about 200° C. Although the heated element ($R_{21}, \ldots, R_{2n}$) penetrates into the color-developing layer 64, due to the thermal fusion of the color developer component "X", the black pressure-sensitive microcapsules 68BK, included in the penetrated area of the color-developing layer 64, cannot be squashed and broken, due to the low pressure of 0.01 MPa.

When the energization of the element concerned is based on the cyan pixel signal, a cyan dot is produced on the color-developing layer 14, because only cyan is developed as the heating temperature of the element concerned is 150° C. less than the breakage temperature (180° C.) of the magenta heat-sensitive microcapsules 68M. Also, when the energization of the element concerned is based on the blue pixel signal, a blue dot is produced on the color-developing layer 64, because both cyan and magenta are developed as the heating temperature of the element is 200° C. more than the breakage temperature (180° C.) of the magenta heat-sensitive microcapsules 68M.

Note that the various changes and modifications of the preceding embodiments may be applied to the fourth embodiment, where possible.

Figure 10:
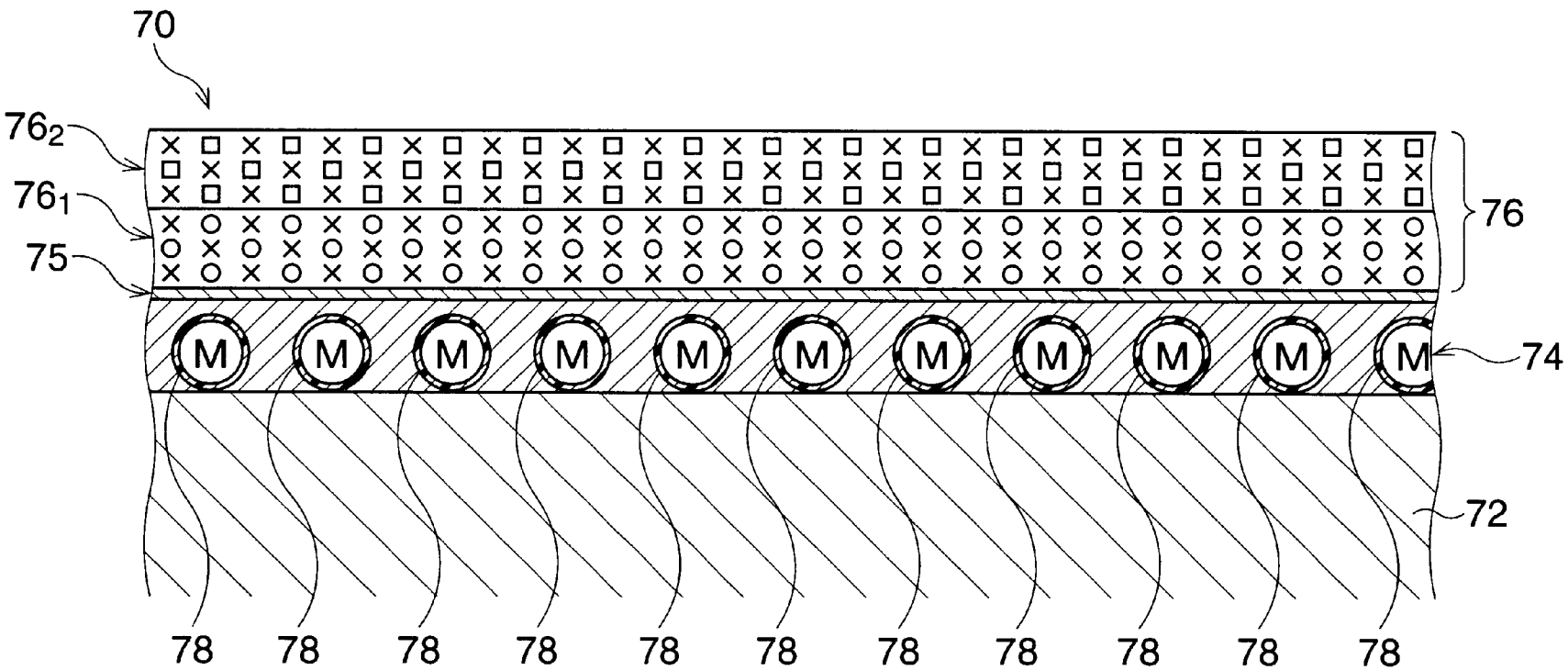
FIG. 10 is a schematic conceptual cross-sectional view showing a fifth embodiment of a multi-color image-forming medium, according to the present invention.

FIG. 10 schematically shows a fifth embodiment of a multi-color image-forming medium, generally indicated by reference numeral 70, according to the present invention. The multi-color image-forming medium 70 comprises a sheet-like substrate, such as a sheet of paper 72, a pressure/heat-sensitive color-developing layer 74 coated thereon, a boundary layer 75 formed on the pressure/heat-sensitive color-developing layer 74, and a heat-sensitive color-developing layer 76 coated on the boundary layer 75.

The pressure/heat-sensitive color-developing layer 74 is constituted as a binder layer containing a plurality of pressure-sensitive microcapsules 78 uniformly distributed therein, and the microcapsules 78 are essentially identical to the pressure-sensitive microcapsules 18 utilized in the first embodiment. Namely, the microcapsules 78 are filled with the magenta ink or dye composed of the transparent oil (KMC-113) and Rhodamine Lake T dispersed or dissolved therein, and have an average diameter of about 5 to 6 $\mu$m. The heat-sensitive color-developing layer 76 is formed as a double-layer structure including a first heat-sensitive layer section $\mathbf{76}_1$ coated on the boundary layer 75, and a second heat-sensitive layer section $\mathbf{76}_2$ coated thereon.

The first heat-sensitive layer section $\mathbf{76}_1$ is composed of a leuco-pigment represented by symbols "○", and a color developer component represented by symbols "X". Similarly, the second heat-sensitive layer section $\mathbf{76}_2$ is composed of a leuco-pigment represented by symbols "○", and a color developer component represented by symbols "X". Similar to the first embodiment, the leuco-pigment component "○" is composed of a black-developing leuco-pigment for which ODB is utilized, and the leuco-pigment component "□" is composed of a cyan-developing leuco-pigment for which Blue-220 is utilized. Also, for the color developer component "X", K-5 is utilized.

To produce the pressure/heat-sensitive color-developing layer 74, an aqueous compound $E_0$ is prepared, composed as shown in the following table:

| COMPOSITIONS | PARTS BY WEIGHT |
|---|---|
| (1) 25 wt. % microcapsule aqueous dispersion | 1.0 |
| (2) 17 wt. % carnauba wax aqueous dispersion | 1.0 |
| (3) 20 wt. % PVA aqueous solution | 0.5 |

Herein:

The composition (1) is prepared by mixing 25 wt. % of the microcapsules 78 with purified water;

The composition (2) is prepared by mixing 17 wt. % of milled carnauba wax with purified water, carnauba wax exhibiting a melting point of about 83° C.; and The composition (3) is prepared by dissolving 20 wt. % of polyvinyl alcohol (PVA) in purified water, PVA exhibiting a polymerization degree of 500.

The paper sheet 72 is coated with the aqueous compound $E_0$ at about 3 to 5 g per square meter, and then the coated layer is allowed to dray naturally, resulting in production of the pressure/heat-sensitive color-developing layer 74. Successively, the pressure/heat-sensitive color-developing layer 74 is coated with a 10 wt. % PVA aqueous solution at about 1 g per square meter, and then the coated layer is allowed to dry naturally, resulting in production of the boundary layer 75 having a thickness of several microns. Note, the boundary layer 75 may be formed of another material, such as EVA (ethylene-vinyl copolymer), polyvinyl acetate, gum arabic, casein or the like.

To produce the first heat-sensitive layer section $\mathbf{76}_1$, an aqueous compound $E_1$ is prepared, composed as shown in the following table:

| COMPOSITIONS | PARTS BY WEIGHT |
|---|---|
| (1) 17 wt. % OBD aqueous dispersion | 0.2 |
| (2) 17 wt. % K-5 aqueous dispersion | 1.0 |
| (3) 16 wt. % acetoacetic anilide aqueous dispersion | 0.3 |
| (4) 20 wt. % PVA aqueous solution | 0.5 |

Herein:

The composition (1) is prepared by mixing 17 wt. % of OBD (black-developing leuco-pigment) with purified water;

The composition (2) is prepared by mixing 17 wt. % of K-5 (color developer) with purified water;

The composition (3) is prepared by mixing 16 wt. % of acetoacetic anilide (sensitizer) with purified water; and The composition (4) is prepared by dissolving 20 wt. % of polyvinyl alcohol (PVA) in purified water, PVA exhibiting a polymerization degree of 500.

The boundary layer 75 is coated with the aqueous compound $E_1$ at about 1 to 4 g per square meter, and then the coated layer is allowed to dry naturally, resulting in production of the first heat-sensitive layer section $\mathbf{76}_1$. Since the first heat-sensitive layer section $\mathbf{76}_1$ contains acetoacetic anilide (sensitizer), the melting point of the color developer component (K-5) is lowered from 145° C. to about 90° C., and the color-developing temperature of the black-developing leuco-pigment component (ODB) is lowered to about 180° C.

To produce the second heat-sensitive layer section $\mathbf{76}_2$, an aqueous compound $E_2$ is prepared, composed as shown in the following table:

| COMPOSITIONS | PARTS BY WEIGHT |
|---|---|
| (1) 17 wt. % Blue-220 aqueous dispersion | 0.2 |
| (2) 17 wt. % K-5 aqueous dispersion | 1.0 |
| (3) 16 wt. % acetoacetic anilide aqueous dispersion | 0.3 |
| (4) 20 wt. % PVA aqueous solution | 0.5 |

Note that the aqueous compound $E_2$ is essentially identical to the aqueous compound $E_1$ except that the composition (1) is prepared by mixing 17 wt. % of Blue-220 (cyan-developing leuco-pigment) with purified water.

The first heat-sensitive layer section $\mathbf{76}_1$ is coated with the aqueous compound $E_2$ at about 1 to 4 g per square meter, and then the coated layer is allowed to dry naturally, resulting in production of the second heat-sensitive layer section $\mathbf{76}_2$. Since the second heat-sensitive layer section $\mathbf{76}_2$ contains acetoacetic anilide (sensitizer), the melting point of the color developer component (K-5) is lowered from 145° C. to about 90° C., and the color-developing temperature of the cyan-developing leuco-pigment component (Blue-220) is lowered to about 120° C.

Accordingly, the color-developing characteristic of the multi-color image-forming medium 70 is essentially identical to that of the first embodiment (FIG. 2), and thus it is possible to record a multi-color image on both the color-developing layers 74 and 76, using the printer as shown in FIGS. 3 and 4, in substantially the same manner as on the multi-color image-forming medium 10.

Figure 11:
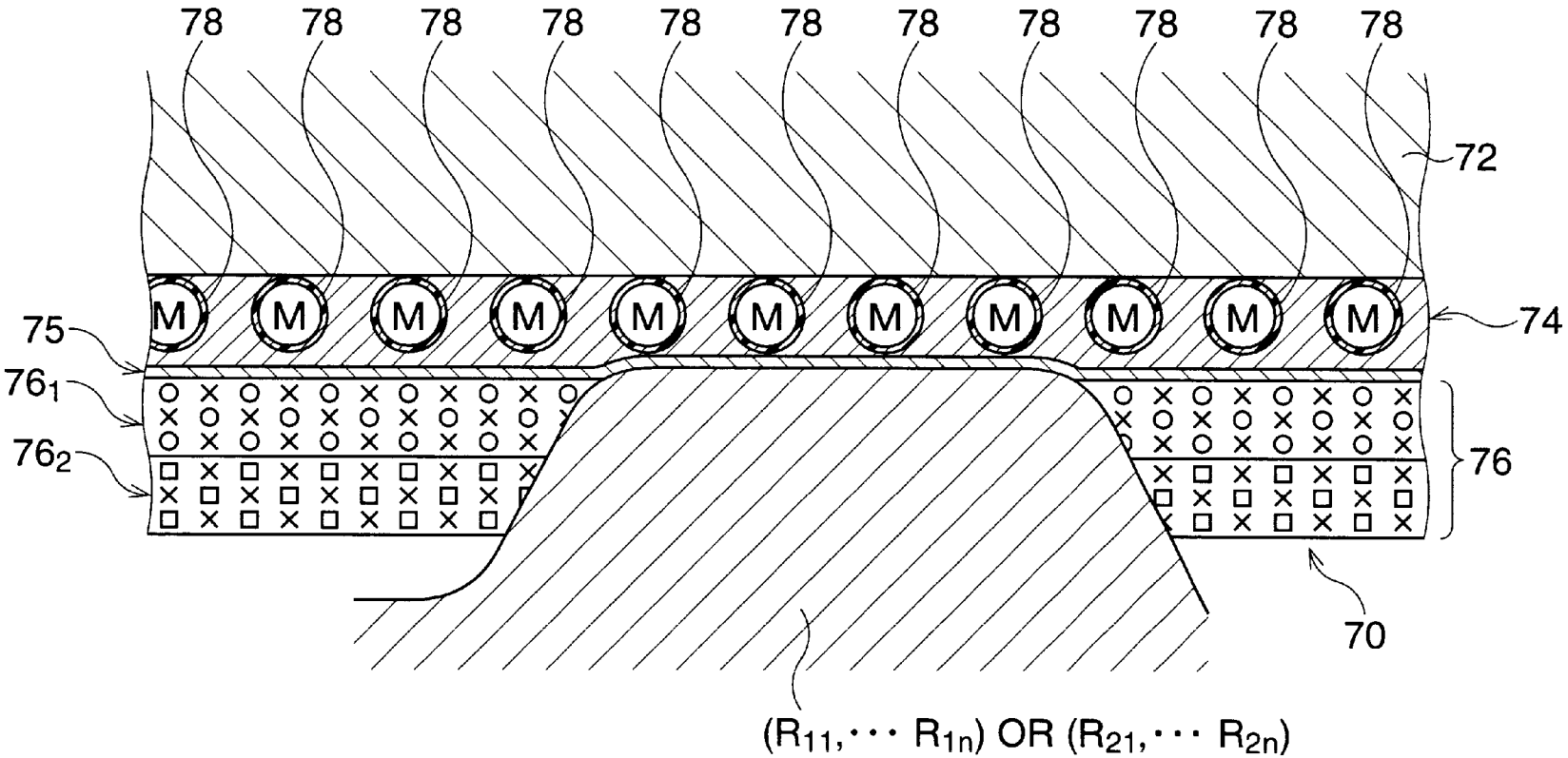
FIG. 11 is a schematic cross-sectional view showing penetration of an electric resistance element of the first or second thermal printing head to thereby develop either a magenta dot, a blue dot, a cyan dot or a black dot on the image-forming medium shown in FIG. 10.

In particular, during the passage of the image-forming medium 70 between the first thermal printing head $\mathbf{30}_1$ and the first roller platen 341 when any one of the electric resistance elements $R_{11}$ to $R_{1n}$ is energized in accordance with either a magenta pixel signal or a blue pixel signal, the resistance element concerned is heated to a temperature of at least 100° C. higher than the melting point 90° C. of the color developer component "X" and the melting point 83° C. of the binder material (carnauba wax). Namely, when the energization is based on the magenta pixel signal, the heating temperature of the element is about 100° C., and when the energization is based on the blue pixel signal, the heating temperature of the element is about 150° C. Thus, the heated resistance element ($R_{11}, \ldots, R_{1n}$) penetrates into both the color-developing layers 74 and 76, as shown in FIG. 11, due to the thermal fusion of the color developer component "X".

Accordingly, the magenta pressure-sensitive microcapsules 78, included in the penetrated area of both the color-developing layers 74 and 76, are directly subjected to the pressure 0.3 MPa, with the shearing force, from the heated element ($R_{11}, \ldots, R_{1n}$), and are thus squashed and broken, resulting in discharge of the magenta dye from the broken microcapsules 78. When the energization of the element is based on the magenta pixel signal, a magenta dot is produced on both the color-developing layers 74 and 76, because only magenta is developed as the heating temperature of the element concerned is 100° C. less than the color-developing temperature (120° C.) of the cyan-developing leuco-pigment component "□". Also, when the energization of the element is based on the blue pixel signal, a blue dot is produced on both the color-developing layers 74 and 76, because both magenta and cyan are developed as the heating temperature of the element is 150° C. more than the color-developing temperature (120° C.) of the cyan-developing leuco-pigment component "□".

On the other hand, while the image-forming medium 70 passes between the second thermal printing head $\mathbf{30}_2$ and the second roller platen $\mathbf{34}_2$, both the color-developing layers 74 and 76 of the image-forming medium 70 are subjected to the pressure of 0.01 MPa with the shearing force from each electric resistance element ($R_{21}, \ldots, R_{2n}$) of the second thermal printing head $\mathbf{30}_2$, which is considerably lower than the critical breaking-pressure of 0.2 MPa of the microcapsules 78. Also, when any one of the electric resistance elements $R_{21}$ to $R_{2n}$ is energized in accordance with either a cyan pixel signal or a black pixel signal, the resistance element concerned is heated to a temperature of at least 150° C. Namely, when the energization is based on the cyan pixel signal, the heating temperature of the element is about 150° C., and when the energization is based on the black pixel signal, the heating temperature of the element is about 200° C.

Thus, although the heated element ($R_{21}, \ldots, R_{2n}$) penetrates into both the color-developing layers 74 and 76 due to the thermal fusion of the color developer component "X" and binder material (carnauba wax), the microcapsules 78, included in the penetrated area of both the color-developing layers 74 and 76, cannot be squashed and broken. In short, none of the microcapsules 78 can be squashed and broken while the image-forming medium 70 passes between the second thermal printing head $\mathbf{30}_2$ and the second roller platen $\mathbf{34}_2$.

In the second thermal printing head $\mathbf{30}_2$, when the energization of the element is based on the cyan pixel signal, a cyan dot is produced on the color-developing layer 76, because only cyan is developed as the heating temperature of the element concerned is 150° C. less than the color-developing temperature (180° C.) of the black-developing leuco-pigment component "○". Also, when the energization of the element is based on the black pixel signal, a black dot is produced on the color-developing layer 76, because the heating temperature of the element is 200° C. more than the color-developing temperature (180° C.) of the black-developing leuco-pigment component "○". Of course, during the production of the black dot, although the cyan is also developed, the developed cyan is absorbed by the black dot.

In the fifth embodiment, the boundary layer 75 is provided for preventing undesirable development of cyan when the pressure-sensitive microcapsules 78 are squashed and broken. In particular, if the boundary layer 75 is omitted from the image-forming medium 70, the cyan-developing leuco-pigment component "□" might be dissolved in the vehicle component (KMC-113) of the magenta dye discharged from the broken microcapsules 78, and the dissolved cyan-developing leuco-pigment component "□" reacts with the color developer component "X", resulting in undesirable development of cyan. However, in reality, the cyan-developing leuco-pigment component "□" cannot be dissolved in the transparent oil component (KMC-113) of the magenta dye due to the existence of the boundary layer 75, and thus the undesirable development of cyan can be prevented. Note, of course, if the cyan-developing leuco-pigment component "□" cannot be dissolved in the vehicle component of the magenta dye, or if the development of cyan is permissible, it is possible to omit the boundary layer 75 from the multi-color image-forming medium 70.

In the fifth embodiment, only one of the first and second heat-sensitive layer sections $\mathbf{76}_1$ and $\mathbf{76}_2$ may be omitted from the heat-sensitive color-developing layer 76, if necessary.

Also, in the fifth embodiment, the heat-sensitive color-developing layer 76 may be formed as a single-layer structure in which the black-developing leuco-pigment component "○", the cyan-developing leuco-pigment component "□" and the color developer component "X" are homogenously mixed.

To form the heat-sensitive color-developing layer 76 as a single-layer structure, an aqueous compound F is prepared, composed as shown in the following table:

| COMPOSITIONS | PARTS BY WEIGHT |
|---|---|
| (1) 17 wt. % ODB aqueous dispersion | 0.2 |
| (2) 17 wt. % Blue-220 aqueous dispersion | 0.2 |
| (3) 17 wt. % K-5 aqueous dispersion | 1.0 |
| (4) 16 wt. % acetoacetic anilide aqueous dispersion | 0.5 |
| (5) 20 wt. % PVA aqueous solution | 0.5 |

Note, the aqueous compound F is essentially identical to the aqueous compound $E_2$ except that the former contains the additional composition (1).

The single-layer structure of the heat-sensitive color-developing layer 76 is obtained by coating the boundary layer 75 with the aqueous compound F at about 1 to 3 g per square meter.

Note that the various changes and modifications of the preceding embodiments may be applied to the fifth embodiment, if possible and if necessary.

Figure 12:
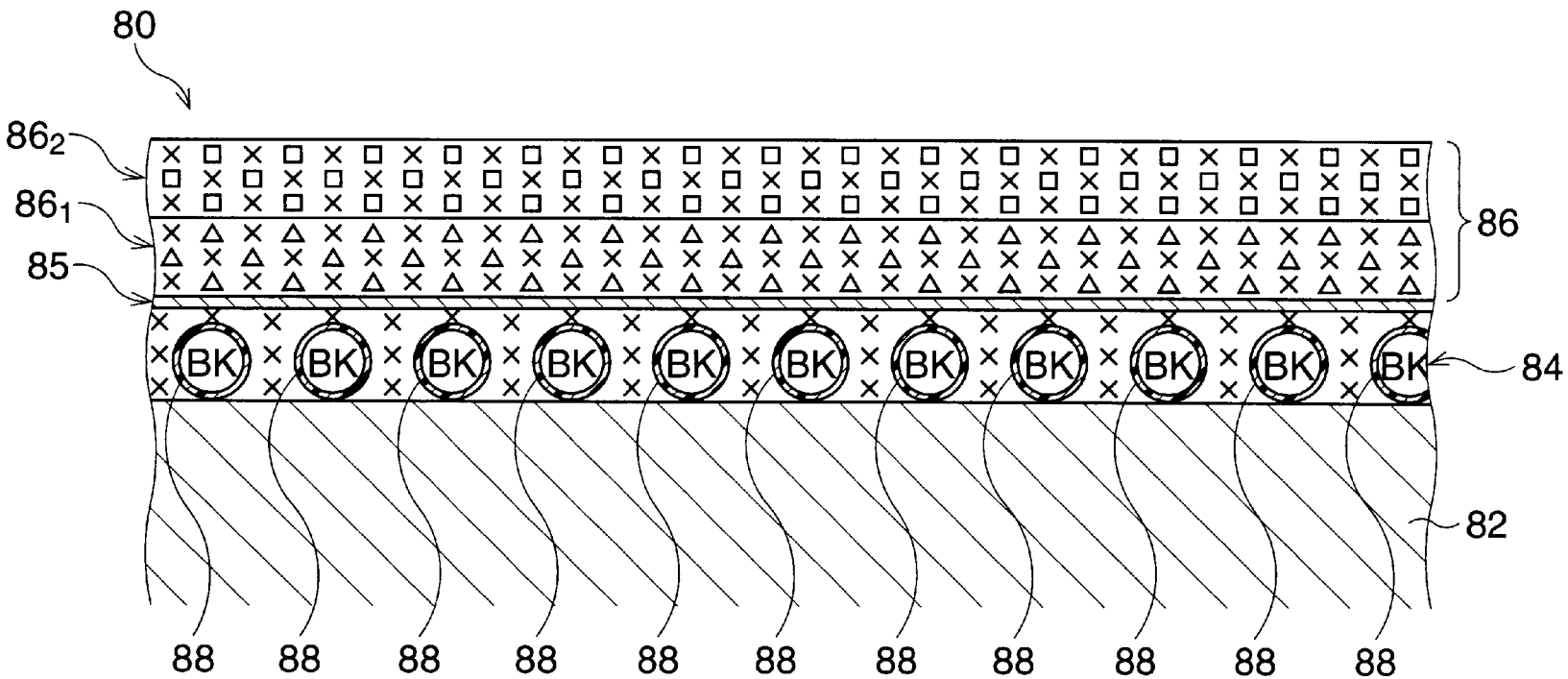
FIG. 12 is a schematic conceptual cross-sectional view showing a sixth embodiment of a multi-color image-forming medium, according to the present invention.

FIG. 12 schematically shows a sixth embodiment of a multi-color image-forming medium, generally indicated by reference numeral 80, according to the present invention. Similar to the fifth embodiment, the multi-color image-forming medium 80 comprises a sheet of paper 82, a pressure/heat-sensitive color-developing layer 84 coated thereon, a boundary layer 85 formed on the pressure/heat-sensitive color-developing layer 84, and a heat-sensitive color-developing layer 86 coated on the boundary layer 85.

The pressure/heat-sensitive color-developing layer 84 is constituted as a binder layer containing a plurality of pressure-sensitive microcapsules 88 uniformly distributed therein, and the microcapsules 88 are essentially identical to the black pressure-sensitive microcapsules 48 utilized in the second embodiment. Namely, the microcapsules 88 are filled with black ink or dye composed of the transparent oil (KMC-113) and the black-developing leuco-pigment (ODB) dispersed or dissolved therein, and have an average diameter of about 5 to 6 $\mu$m. The heat-sensitive color-developing layer 86 is formed as a double-layer structure including a first heat-sensitive layer section $\mathbf{86}_1$ coated on the boundary layer 85, and a second heat-sensitive layer section $\mathbf{86}_2$ coated thereon.

The first heat-sensitive layer section $\mathbf{86}_1$ is composed of a leuco-pigment represented by symbols "Δ", and a color developer component represented by symbols "X". Similarly, the second heat-sensitive layer section $\mathbf{86}_2$ is composed of a leuco-pigment represented by symbols "□", and a color developer component represented by symbols "X". Similar to the second embodiment, the leuco-pigment component "Δ" is composed of a magenta-developing leuco-pigment for which Red-3 is utilized, and the leuco-pigment component "□" is composed of a cyan-developing leuco-pigment for which Blue-220 is utilized. Also, for the color developer component "X", K-5 is utilized.

To produce the pressure/heat-sensitive color-developing layer 84, an aqueous compound $G_0$ is prepared, composed as shown in the following table:

| COMPOSITIONS | PARTS BY WEIGHT |
|---|---|
| (1) 25 wt. % microcapsule aqueous dispersion | 1.0 |
| (2) 17 wt. % K-5 aqueous dispersion | 1.0 |
| (3) 16 wt. % acetoacetic anilide aqueous dispersion | 0.5 |
| (4) 20 wt. % PVA aqueous solution | 0.5 |

Herein:

The composition (1) is prepared by mixing 25 wt. % of the microcapsules 88 with purified water;

The composition (2) is prepared by mixing 17 wt. % of K-5 (color developer) with purified water;

The composition (3) is prepared by mixing 16 wt. % of acetoacetic anilide (sensitizer) with purified water; and The composition (4) is prepared by dissolving 20 wt. % of polyvinyl alcohol (PVA) in purified water, PVA exhibiting a polymerization degree of 500.

The paper sheet 82 is coated with the aqueous compound $G_0$ at about 3 to 5 g per square meter, and then the coated layer is allowed to dry naturally, resulting in production of the pressure/heat-sensitive color-developing layer 84. Successively, the pressure/heat-sensitive color-developing layer 84 is coated with a 10 wt. % PVA aqueous solution at about 1 g per square meter, and then the coated layer is allowed to dry naturally, resulting in production of the boundary layer 85 having a thickness of several microns.

To produce the first heat-sensitive layer section $\mathbf{86}_1$, an aqueous compound $G_1$ is prepared, composed as shown in the following table:

| COMPOSITIONS | PARTS BY WEIGHT |
|---|---|
| (1) 17 wt. % Red-3 aqueous dispersion | 0.2 |
| (2) 17 wt. % K-5 aqueous dispersion | 1.0 |
| (3) 16 wt. % acetoacetic anilide aqueous dispersion | 0.3 |
| (4) 20 wt. % PVA aqueous solution | 0.5 |

Note that the aqueous compound $G_1$ is essentially identical to the aforementioned aqueous compound $E_1$ except that the composition (1) is prepared by mixing 17 wt. % of Red-3 (magenta-developing leuco-pigment) with purified water.

The boundary layer 85 is coated with the aqueous compound $G_1$ at about 1 to 4 g per square meter, and then the coated layer is allowed to naturally dry, resulting in production of the first heat-sensitive layer section $\mathbf{86}_1$. Since the first heat-sensitive layer section $\mathbf{86}_1$ contains acetoacetic anilide (sensitizer), the melting point of the color developer component (K-5) is lowered from 145° C. to about 90° C., and the color-developing temperature of the magenta-developing leuco-pigment component (Red-3) is lowered to about 180° C.

The second heat-sensitive layer section 862 is essentially identical to the second heat-sensitive layer section $\mathbf{76}_2$ of the fifth embodiment. Namely, the second heat-sensitive layer section $\mathbf{86}_2$ is produced by coating the first heat-sensitive layer section $\mathbf{86}_2$ with the aforementioned aqueous compound $E_2$ at about 1 to 4 g per square meter, and by allowing the coated layer to dry naturally. Of course, since the second heat-sensitive layer section $\mathbf{86}_2$ contains acetoacetic anilide (sensitizer), the melting point of the color developer component (K-5) is lowered from 145° C. to about 90° C., and the color-developing temperature of the cyan-developing leuco-pigment component (Blue-220) is lowered to about 120° C.

Accordingly, a color-developing characteristic of the multi-color image-forming medium 80 is essentially identical to that of the second embodiment (FIG. 7), and thus it is possible to record a multi-color image on both the color-developing layers 84 and 86, using the printer as shown in FIGS. 3 and 4, in substantially the same manner as on the multi-color image-forming medium 40.

In particular, during the passage of the image-forming medium 80 between the first thermal printing head $\mathbf{30}_1$ and the first roller platen $\mathbf{34}_1$, when any one of the electric resistance elements $R_{11}$ to $R_{1n}$ is energized in accordance with a black pixel signal, the resistance element concerned is heated to a temperature of 100° C. higher than the melting point 90° C. of the color developer component "X". Accordingly, the heated resistance element ($R_{11}, \ldots, R_{1n}$) penetrates into both the color-developing layers 84 and 86, due to the thermal fusion of the color developer component "X", whereby the microcapsules 88, included in the penetrated area of both the color-developing layers 84 and 86, are directly subjected to the pressure 0.3 MPa, with the shearing force, from the heated element ($R_{11}, \ldots, R_{1n}$), and are thus squashed and broken, resulting in discharge of the black dye from the broken microcapsules 88. In short, a black dot is produced on both the color-developing layers 84 and 86.

On the other hand, during the passage of the image-forming medium 80 between the second thermal printing head $\mathbf{30}_2$ and the second roller platen $\mathbf{34}_2$, when any one of the electric resistance elements $R_{21}$ to $R_{2n}$ is energized in accordance with either a cyan pixel signal or a blue pixel signal, the element concerned is heated to a temperature of at least 150° C. Namely, when the energization is based on the cyan pixel signal, the heating temperature of the element is about 150° C., and when the energization is based on the blue pixel signal, the heating temperature of the element is about 200° C. Although the heated element ($R_{21}, \ldots, R_{2n}$) penetrates into the color-developing layer 84, due to the thermal fusion of the color developer component "X", the microcapsules 88, included in the penetrated area of both the color-developing layers 84 and 86, cannot be squashed and broken, due to the low pressure of 0.01 MPa.

When the energization of the element is based on the cyan pixel signal, a cyan dot is produced on both the color-developing layers 84 and 86, because only cyan is developed as the heating temperature of the element concerned is 150° C. less than the color-developing temperature (180° C.) of the magenta-developing leuco-pigment component "Δ". Also, when the energization of the element is based on the blue pixel signal, a blue dot is produced on both the color-developing layers 84 and 86, because both cyan and magenta are developed as the heating temperature of the element is 200° C. more than the color-developing temperature (180° C.) of the magenta-developing leuco-pigment component "Δ".

Similar to the second embodiment, in the sixth embodiment, when black is developed on the color-developing layer 84, neither cyan or magenta can be developed. Namely, since the developed black is prevented from being mixed with either cyan or magenta, it is possible to obtain the black dot as a pure or vivid black dot.

Note that the various changes and modifications of the preceding embodiments may be applied to the sixth embodiment, where possible.

Figure 13:
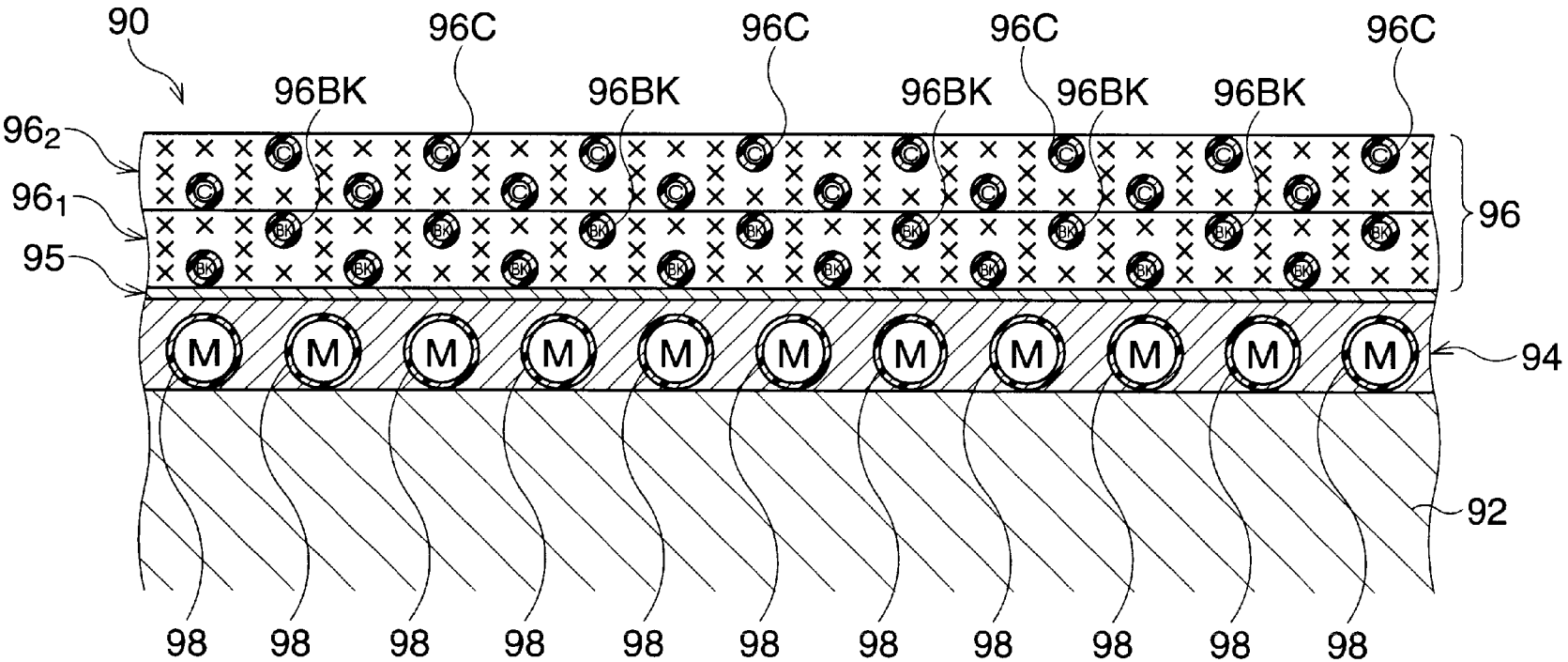
FIG. 13 is a schematic conceptual cross-sectional view showing a seventh embodiment of a multi-color image-forming medium, according to the present invention.

FIG. 13 schematically shows a seventh embodiment of a multi-color image-forming medium, generally indicated by reference numeral 90, according to the present invention. The multi-color image-forming medium 90 also comprises a sheet of paper 92, a-pressure/heat-sensitive color-developing layer 94 coated thereon, a boundary layer 95 formed on the pressure/heat-sensitive color-developing layer 94, and a heat-sensitive color-developing layer 96 coated on the boundary layer 95.

The pressure/heat-sensitive color-developing layer 94 is essentially identical to the pressure/heat-sensitive color-developing layer 74 of the fifth embodiment, and is produced in essentially the same manner as stated above. Namely, the pressure/heat-sensitive color-developing layer 94 is formed as a binder layer containing a plurality of pressure-sensitive microcapsules 98 uniformly distributed therein, and the microcapsules 98 are essentially identical to the pressure-sensitive microcapsules 18 utilized in the first embodiment. Namely, each microcapsule 98 is filled with the magenta ink or dye composed of the transparent oil (KMC-113) and Rhodamine Lake T dispersed or dissolved therein.

The heat-sensitive color-developing layer 96 is formed as a double-layer structure including a first heat-sensitive layer section $96_1$ coated on the boundary layer 95, and a second heat-sensitive layer section $\mathbf{96}_2$ coated thereon. In the seventh embodiment, the first heat-sensitive layer section $\mathbf{96}_1$ is formed as a color developer layer containing a plurality of heat-sensitive microcapsules 98BK uniformly distributed therein, and the second heat-sensitive layer section $\mathbf{96}_2$ is formed as a color developer layer containing a plurality of heat-sensitive microcapsules 98C uniformly distributed therein. Each color developer layer is composed of a color developer component, such as K-5, represented by symbols "X".

The respective heat-sensitive microcapsules 98BK and 98C are essentially identical to the heat-sensitive microcapsules 5BK and 58C used in the third embodiment (FIG. 8). Namely, the black-developing pigment (ODB) is encapsulated as a powder in each microcapsule 98BK, and a shell wall of each microcapsule 98BK is formed to be thermally broken at a temperature of more than about 180° C. Also, the cyan-developing leuco-pigment (Blue-220) is encapsulated as a powder in each microcapsule 98C, and a shell wall of each microcapsule 98C is formed to be thermally broken at a temperature of more than about 120° C.

Similar to the fifth embodiment shown in FIG. 10, after the pressure/heat-sensitive color-developing layer 94 is produced on the sheet paper 92, it is coated with a 10 wt. % PVA aqueous solution at about 1 g per square meter, and then the coated layer is allowed to dry naturally, resulting in production of the boundary layer 95 having a thickness of several microns.

To produce the first heat-sensitive layer section $\mathbf{96}_1$, an aqueous compound $H_1$ is prepared, composed as shown in the following table:

| COMPOSITIONS | PARTS BY WEIGHT |
|---|---|
| (1) 25 wt. % microcapsule aqueous dispersion (98BK) | 1.0 |
| (2) 20 wt. % K-5 aqueous dispersion | 1.0 |
| (3) 17 wt. % acetoacetic anilide aqueous dispersion | 0.5 |
| (4) 20 wt. % PVA aqueous solution | 0.5 |

Herein:

The composition (1) is prepared by mixing 25 wt. % of the black microcapsules 98BK with purified water;

The composition (2) is prepared by mixing 20 wt. % of K-5 (color developer) with purified water;

The composition (3) is prepared by mixing 17 wt. % of acetoacetic anilide (sensitizer) with purified water; and The composition (4) is prepared by dissolving 20 wt. % of polyvinyl alcohol (PVA) in purified water, PVA exhibiting a polymerization degree of 500.

The boundary layer 95 is coated with the aqueous compound H1 at about 1 to 3 g per square meter, and then the coated layer is allowed to dry naturally, resulting in production of the first heat-sensitive layer section $\mathbf{96}_1$. Since the first heat-sensitive layer section $\mathbf{96}_1$ contains acetoacetic anilide (sensitizer), the melting point of the color developer component (K-5) is lowered from 145° C. to about 90° C., and the color-developing temperature of the black-developing leuco-pigment component (ODB) is lowered to about 180° C.

To produce the second heat-sensitive layer section $\mathbf{96}_2$, an aqueous compound $H_2$ is prepared, composed as shown in the following table:

| COMPOSITIONS | PARTS BY WEIGHT |
|---|---|
| (1) 25 wt. % microcapsule aqueous dispersion (96C) | 1.0 |
| (2) 20 wt. % K-5 aqueous dispersion | 1.0 |

-continued

| COMPOSITIONS | PARTS BY WEIGHT |
|---|---|
| (3) 17 wt. % acetoacetic anilide aqueous dispersion | 0.5 |
| (4) 20 wt. % PVA aqueous solution | 0.5 |

Note that the aqueous compound $H_2$ is essentially identical to the aqueous compound $H_1$ except that the composition (1) is prepared by mixing 25 wt. % of the cyan microcapsules 96C with purified water.

The first heat-sensitive layer section $\mathbf{96}_1$ is coated with the aqueous compound $H_2$ at about 1 to 3 g per square meter, and then the coated layer is allowed to dry naturally, resulting in production of the second heat-sensitive layer section $\mathbf{96}_2$. Since the second heat-sensitive layer section $\mathbf{96}_2$ contains acetoacetic anilide (sensitizer), the melting point of the color developer component (K-5) is lowered from 145° C. to about 90° C., and the color-developing temperature of the cyan-developing leuco-pigment component (Blue-220) is lowered to about 120° C.

Accordingly, the color-developing characteristic of the multi-color image-forming medium 90 is essentially identical to that of the first embodiment (FIG. 2), and thus it is possible to record a multi-color image on both the color-developing layers 94 and 96, using the printer as shown in FIGS. 3 and 4, in substantially the same manner as on the multi-color image-forming medium 10.

In particular, during the passage of the image-forming medium 90 between the first thermal printing head $\mathbf{30}_1$ and the first roller platen $\mathbf{34}_1$ when any one of the electric resistance elements $R_{11}$ to $R_{1n}$ is energized in accordance with either a magenta pixel signal or a blue pixel signal, the resistance element concerned is heated to a temperature of at least 100° C. higher than the melting point 90° C. of the color developer component "X" and the melting point 83° C. of the binder material (carnauba wax). Namely, when the energization is based on the magenta pixel signal, the heating temperature of the element is about 100° C., and when the energization is based on the blue pixel signal, the heating temperature of the element is about 150° C. Thus, the heated resistance element ($R_{11}, \ldots, R_{1n}$) penetrates into both the color-developing layers 94 and 96, due to the thermal fusion of the color developer component "X" and binder material (carnauba wax).

Accordingly, the magenta pressure-sensitive microcapsules 98, included in the penetrated area of both the color-developing layers 94 and 96, are directly subjected to the pressure 0.3 MPa, with the shearing force, from the heated element ($R_{11}, \ldots, R_{1n}$), and are thus squashed and broken, resulting in discharge of the magenta dye from the broken microcapsules 98. When the energization of the element is based on the magenta pixel signal, a magenta dot is produced on both the color-developing layers 94 and 96, because only magenta is developed as the heating temperature of the element concerned is 100° C. less than the breakage temperature (120° C.) of the cyan heat-sensitive microcapsules 98C. Also, when the energization of the element is based on the blue pixel signal, a blue dot is produced on both the color-developing layers 94 and 96, because both magenta and cyan are developed as the heating temperature of the element is 150° C. more than the breakage temperature (120° C.) of the cyan microcapsules 98C.

On the other hand, while the image-forming medium 90 passes between the second thermal printing head $\mathbf{30}_2$ and the second roller platen $\mathbf{34}_2$, both the color-developing layers 94 and 96 of the image-forming medium 90 is subjected to the pressure of 0.01 MPa with the shearing force from each electric resistance element ($R_{21}$, . . . , $R_{2n}$) of the second thermal printing head 30$_2$, which is considerably lower than the critical breaking-pressure of 0.2 MPa of the microcapsules 98. Also, when any one of the electric resistance elements $R_{21}$ to $R_{2n}$ is energized in accordance with either a cyan pixel signal or a black pixel signal, the resistance element concerned is heated to a temperature of at least 150° C. Namely, when the energization is based on the cyan pixel signal, the heating temperature of the element is about 150° C., and when the energization is based on the black pixel signal, the heating temperature of the element is about 200° C.

Thus, although the heated element ($R_{21}$, . . . , $R_{2n}$) penetrates into both the color-developing layers 94 and 96 due to the thermal fusion of the color developer component "X" and binder material (carnauba wax), the microcapsules 98, included in the penetrated area of both the color-developing layers 94 and 96, cannot be squashed and broken. In short, none of the microcapsules 98 can be squashed and broken while the image-forming medium 90 passes between the second thermal printing head 30$_2$ and the second roller platen 34$_2$.

In the second thermal printing head 30$_2$, when the energization of the element is based on the cyan pixel signal, a cyan dot is produced on the color-developing layer 54, because only cyan is developed as the heating temperature of the element concerned is 150° C. less than the breakage temperature (180° C.) of the black heat-sensitive microcapsules 98BK. Also, when the energization of the element is based on the black pixel signal, a black dot is produced on the color-developing layer 54, because the heating temperature of the element is 200° C. more than the breakage temperature (180° C.) of the black heat-sensitive microcapsules 98BK. Of course, during the production of the black dot, although the cyan is also developed, the developed cyan is absorbed by the black dot.

Note that the various changes and modifications of the preceding embodiments may be applied to the seventh embodiment, where possible.

Finally, it will be understood by those skilled in the art that the foregoing description is of preferred embodiments of the medium, and that various changes and modifications may be made to the present invention without departing from the spirit and scope thereof.

The disclosure relates to subject matters contained in Japanese Patent Applications No. 2000-129419 (filed on Apr. 28, 2000) and No. 2000-133768 (filed on May 2, 2000), which are expressly incorporated herein, by reference, in their entireties.

What is claimed is:

1. A multi-color image-forming medium comprising:

a substrate; and a color-developing layer coated on said substrate, wherein said color-developing layer is formed as a heat-sensitive color-developing layer containing a plurality of pressure-sensitive microcapsules uniformly distributed therein; each of said pressure-sensitive microcapsules is filled with a dye exhibiting a first single-color, and features a pressure characteristic to be broken when being subjected to a predetermined pressure; said heat-sensitive color-developing layer features a thermal characteristic to be molten when being subjected to a first temperature, so that said pressure-sensitive microcapsules can be directly subjected to said predetermined pressure; and said heat-sensitive color-developing layer further features a thermal-color-developing characteristic to develop a second single-color when being subjected to a second temperature more than said first temperature.

2. A multi-color image-forming medium as set forth in claim 1, wherein said heat-sensitive color-developing layer is composed of a first leuco-pigment component, and a color developer component for said first leuco-pigment component, said color developer component being thermally molten under at least said first temperature, said first leuco-pigment component reacting with said color developer component to thereby develop said second single-color under at least said second temperature.

3. A multi-color image-forming medium as set forth in claim 2, wherein said heat-sensitive color-developing layer contains a sensitizer component that regulates a color-developing temperature of said leuco-pigment component such that said leuco-pigment component reacts with said color developer component under at least said second temperature.

4. A multi-color image-forming medium as set forth in claim 2, wherein said heat-sensitive color-developing layer further contains a second leuco-pigment component which reacts with said color developer component to thereby develop a third single-color under at least a third temperature more than said second temperature.

5. A multi-color image-forming medium as set forth in claim 1, wherein said heat-sensitive color-developing layer is composed of a first type of heat-sensitive microcapsule filled with a first leuco-pigment, and a color developer component for said first leuco-pigment, said color developer component being molten under at least said first temperature, said first type of heat-sensitive microcapsule featuring a thermal characteristic to be thermally broken when being subjected to at least said second temperature, said first leuco-pigment reacting with said color developer component to thereby develop said second single-color under at least said second temperature.

6. A multi-color image-forming medium as set forth in claim 5, wherein said heat-sensitive color-developing layer contains a sensitizer component that regulates a color-developing temperature of said first leuco-pigment such that said first leuco-pigment reacts with said color developer component under at least said second temperature.

7. A multi-color image-forming medium as set forth in claim 5, wherein said heat-sensitive color-developing layer further contains a second type of heat-sensitive microcapsule filled with a second leuco-pigment, said second type of heat-sensitive microcapsule featuring a thermal characteristic to be thermally broken when being subjected to at least a third temperature more than said second temperature, said second leuco-pigment reacting with said color developer component to thereby develop a third single-color under at least said third temperature.

8. A multi-color image-forming medium as set forth in claim 1, wherein said first temperature is less than 100° C.

9. A multi-color image-forming medium comprising:

a substrate;

a pressure/heat-sensitive color-developing layer coated on said substrate and containing a plurality of pressure-sensitive microcapsules uniformly distributed therein, each pressure-sensitive microcapsule being filled with a dye exhibiting a first single-color, and featuring a pressure characteristic to be broken when being subjected to a predetermined pressure; and a first heat-sensitive color-developing layer coated on said pressure/heat-sensitive color-developing layer, wherein said pressure/heat-sensitive color-developing layer is composed of a binder component for said pressure-sensitive microcapsules, said binder component featuring a thermal characteristic to be thermally molten when being subjected to a first temperature, so that said pressure-sensitive microcapsules can be directly subjected to said predetermined pressure; and said first heat-sensitive color-developing layer features a thermal-color-developing characteristic to develop a second single-color when being subjected to a second temperature more than said first temperature.

10. A multi-color image-forming medium as set forth in claim 9, wherein said first heat-sensitive color-developing layer is composed of a first leuco-pigment component, and a color developer component for said first leuco-pigment component, said color developer component being thermally molten under at least said first temperature, said first leuco-pigment component reacting with said color developer component to thereby develop said second single-color under at least said second temperature.

11. A multi-color image-forming medium as set forth in claim 10, wherein said first heat-sensitive color-developing layer contains a sensitizer component that regulates a color-developing temperature of said first leuco-pigment component such that said first leuco-pigment component reacts with said color developer component under at least said second temperature.

12. A multi-color image-forming medium as set forth in claim 9, further comprising a second heat-sensitive color-developing layer coated on said first heat-sensitive color-developing layer, said second heat-sensitive color-developing layer featuring a thermal-color-developing characteristic to develop a third single-color when being subjected to a third temperature more than said first temperature but less than said second temperature.

13. A multi-color image-forming medium as set forth in claim 12, wherein said first heat-sensitive color-developing layer is composed of a first leuco-pigment component, and a color developer component for said first leuco-pigment component, said color developer component being molten under at least said first temperature, said first leuco-pigment component reacting with said color developer component to thereby develop said second single-color under at least said second temperature; and wherein said second heat-sensitive color-developing layer is composed of a second leuco-pigment component, and a color developer component for said second leuco-pigment component, said color developer component being molten under at least said first temperature, said second leuco-pigment component reacting with said color developer component to thereby develop said third single-color under at least said third temperature.

14. A multi-color image-forming medium as set forth in claim 13, wherein said first heat-sensitive color-developing layer contains a first sensitizer component that regulates a color-developing temperature of said first leuco-pigment component such that said first leuco-pigment component reacts with said color developer component under at least said second temperature; and wherein said second heat-sensitive color-developing layer contains a second sensitizer component that regulates a color-developing temperature of said second leuco-pigment component such that said second leuco-pigment component reacts with said color developer component under at least said third temperature.

15. A multi-color image-forming medium as set forth in claim 13, further comprising a boundary layer interposed between said pressure/heat-sensitive color-developing layer and said first heat-sensitive color-developing layer to thereby prevent a dye, discharged from a broken pressure-sensitive microcapsule, from being in contact with said first heat-sensitive color-developing layer.

16. A multi-color image-forming medium as set forth in claim 12, wherein said first heat-sensitive color-developing layer is composed of a first type heat-sensitive microcapsule filled with a first leuco-pigment, and a color developer component for said first leuco-pigment component, said color developer component being molten under at least said first temperature, said first type of heat-sensitive microcapsule featuring a thermal characteristic to be thermally broken when being subjected to at least said second temperature, said first leuco-pigment reacting with said color developer component to thereby develop said second single-color under at least said second temperature; and wherein said second heat-sensitive color-developing layer is composed of a second type heat-sensitive microcapsule filled with a second leuco-pigment, and a color developer component for said second leuco-pigment component, said color developer component being molten under at least said first temperature, said second type of heat-sensitive microcapsule featuring a thermal characteristic to be thermally broken when being subjected to at least said third temperature, said third leuco-pigment reacting with said color developer component to thereby develop said third single-color under at least said third temperature.

17. A multi-color image-forming medium as set forth in claim 16, wherein said first heat-sensitive color-developing layer contains a first sensitizer component that regulates a color-developing temperature of said first leuco-pigment component such that said first leuco-pigment component reacts with said color developer component under at least said second temperature; and wherein said second heat-sensitive color-developing layer contains a second sensitizer component that regulates a color-developing temperature of said second leuco-pigment component such that said second leuco-pigment component reacts with said color developer component under at least said third temperature.

18. A multi-color image-forming medium as set forth in claim 16, further comprising a boundary layer interposed between said pressure/heat-sensitive color-developing layer and said first heat-sensitive color-developing layer to thereby prevent a dye, discharged from a broken pressure-sensitive microcapsule, from being in contact with said first heat-sensitive color-developing layer.

19. A multi-color image-forming medium as set forth in claim 9, further comprising a second heat-sensitive color-developing layer interposed between said pressure/heat-sensitive color-developing layer and said first heat-sensitive color-developing layer, said second heat-sensitive color-developing layer featuring a thermal-color-developing characteristic to develop a third single-color when being subjected to a third temperature more than said first temperature but less than said second temperature.

20. A multi-color image-forming medium as set forth in claim 19, wherein said first heat-sensitive color-developing layer is composed of a first leuco-pigment component, and a color developer component for said first leuco-pigment component, said color developer component being thermally molten under at least said first temperature, said first leuco-pigment component reacting with said color developer component to thereby develop said second single-color under at least said second temperature; and wherein said second heat-sensitive color-developing layer is composed of a second leuco-pigment component, and a color developer component for said second leuco-pigment component, said color developer component being molten under at least said first temperature, said second leuco-pigment component reacting with said color developer component to thereby develop said third single-color under at least said third temperature.

21. A multi-color image-forming medium as set forth in claim 20, wherein said first heat-sensitive color-developing layer contains a first sensitizer component that regulates a color-developing temperature of said first leuco-pigment component such that said first leuco-pigment component reacts with said color developer component under at least said second temperature; and wherein said second heat-sensitive color-developing layer contains a second sensitizer component that regulates a color-developing temperature of said second leuco-pigment component such that said second leuco-pigment component reacts with said color developer component under at least said third temperature.

22. A multi-color image-forming medium as set forth in claim 20, further comprising a boundary layer interposed between said pressure/heat-sensitive color-developing layer and said first heat-sensitive color-developing layer to thereby prevent a dye, discharged from a broken pressure-sensitive microcapsule, from being in contact with said second heat-sensitive color-developing layer.

23. A multi-color image-forming medium as set forth in claim 19, wherein said first heat-sensitive color-developing layer is composed of a first type heat-sensitive microcapsule filled with a first leuco-pigment, and a color developer component for said first leuco-pigment component, said color developer component being molten under at least said first temperature, said first type of heat-sensitive microcapsule featuring a thermal characteristic to be thermally broken when being subjected to at least said second temperature, said first leuco-pigment reacting with said color developer component to thereby develop said second single-color under at least said second temperature; and wherein said second heat-sensitive color-developing layer is composed of a second type heat-sensitive microcapsule filled with a second leuco-pigment, and a color developer component for said second leuco-pigment component, said color developer component being thermally molten under at least said first temperature, said second type of heat-sensitive microcapsule featuring a thermal characteristic to be thermally broken when being subjected to at least said third temperature, said third leuco-pigment reacting with said color developer component to thereby develop said third single-color under at least said third temperature.

24. A multi-color image-forming medium as set forth in claim 23, wherein said first heat-sensitive color-developing layer contains a first sensitizer component that regulates a color-developing temperature of said first leuco-pigment component such that said first leuco-pigment component reacts with said color developer component under at least said second temperature; and wherein said second heat-sensitive color-developing layer contains a second sensitizer component that regulates a color-developing temperature of said second leuco-pigment component such that said second leuco-pigment component reacts with said color developer component under at least said third temperature.

25. A multi-color image-forming medium as set forth in claim 23, further comprising a boundary layer interposed between said pressure/heat-sensitive color-developing layer and said first heat-sensitive color-developing layer to thereby prevent a dye, discharged from a broken pressure-sensitive microcapsule, from being in contact with said second heat-sensitive color-developing layer.

26. A multi-color image-forming medium as set forth in claim 9, wherein said first heat-sensitive color-developing layer is composed of a first type heat-sensitive microcapsule filled with a first leuco-pigment, and a color developer component for said first leuco-pigment component, said color developer component being molten under at least said first temperature, said first type of heat-sensitive microcapsule featuring a thermal characteristic to be thermally broken when being subjected to at least said second temperature, said first leuco-pigment reacting with said color developer component to thereby develop said second single-color under at least said second temperature.

27. A multi-color image-forming medium as set forth in claim 26, wherein said first heat-sensitive color-developing layer contains a sensitizer component that regulates a color-developing temperature of said first leuco-pigment component such that said first leuco-pigment component reacts with said color developer component under at least said second temperature.

28. A multi-color image-forming medium as set forth in claim 9, wherein said first temperature is less than 100° C.

* * * * *